US010900294B2

(12) United States Patent
Dorin et al.

(10) Patent No.: US 10,900,294 B2
(45) Date of Patent: Jan. 26, 2021

(54) PULLBACK SYSTEM FOR DRILLING TOOL

(71) Applicant: Vermeer Manufacturing Company, Pella, IA (US)

(72) Inventors: Tyler J. Dorin, Pleasant Hill, IA (US); Andrew J. Kreimeyer, Knoxville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 16/526,032

(22) Filed: Jul. 30, 2019

(65) Prior Publication Data

US 2020/0063500 A1 Feb. 27, 2020

Related U.S. Application Data

(60) Provisional application No. 62/721,020, filed on Aug. 22, 2018.

(51) Int. Cl.

| | |
|---|---|
| ***E21B 12/00*** | (2006.01) |
| ***E21B 7/04*** | (2006.01) |
| *B27B 27/02* | (2006.01) |
| *B27B 27/06* | (2006.01) |

(52) U.S. Cl.

CPC ..... *E21B 12/00* (2013.01); *E21B 7/046* (2013.01); *B27B 27/02* (2013.01); *B27B 27/06* (2013.01)

(58) Field of Classification Search

CPC ..... E21B 12/00; E21B 7/046; B25B 27/02; B25B 27/06

See application file for complete search history.

(56) References Cited

U.S. PATENT DOCUMENTS

| | | | | |
|---|---|---|---|---|
| 2,191,021 | A | 2/1940 | Ladd et al. | |
| 2,834,100 | A | 5/1958 | Harsh | |
| 4,174,759 | A | 11/1979 | Arbuckle | |
| 6,279,667 | B1 * | 8/2001 | Culver | E21B 7/046 175/19 |
| 6,299,382 | B1 * | 10/2001 | Wentworth | B25B 27/023 29/426.5 |

(Continued)

FOREIGN PATENT DOCUMENTS

| | | | |
|---|---|---|---|
| GB | 2424433 | A | 9/2006 |

OTHER PUBLICATIONS

"TriHawk I with Pullback", https://www.ditchwitch.com/parts-service/digging-systems/bits, Charles Machine Works Company (Publicly available at least as early as Aug. 22, 2018).

(Continued)

*Primary Examiner* — Nicole Coy

(74) *Attorney, Agent, or Firm* — Michael Best and Friedrich LLP

(57) ABSTRACT

A pullback system for installing product in a hole includes a rotary drill bit having a plurality of cutter elements, and a pullback device that is attachable to the rotary drill bit without disassembling the rotary drill bit or removing the rotary drill bit from a drill string. The pullback device includes a frame member and a plurality of anchor arms. Each anchor arm has a first end coupled to the frame member and a second end. Each anchor arm is configured to extend between adjacent cutter elements of the rotary drill bit. An attachment location can be used to attach product to the pullback device.

20 Claims, 30 Drawing Sheets

(56) References Cited

U.S. PATENT DOCUMENTS

| | | | | |
|---|---|---|---|---|
| 8,079,123 | B2 | 12/2011 | Lin | |
| 8,122,979 | B1 * | 2/2012 | Wright, Jr. | E21B 10/62 175/398 |
| 8,544,569 | B2 * | 10/2013 | Wright | E21B 10/62 175/398 |
| 9,169,946 | B2 | 10/2015 | Crane et al. | |
| 9,290,994 | B2 | 3/2016 | Webb | |
| 9,611,696 | B2 | 4/2017 | Crane et al. | |
| 9,719,344 | B2 * | 8/2017 | Melsheimer | E21B 7/046 |
| 9,771,759 | B2 | 9/2017 | Cooper | |
| 10,024,105 | B2 * | 7/2018 | Wright | E21B 7/046 |
| 10,208,541 | B2 | 2/2019 | Hoelting et al. | |
| 10,246,993 | B2 * | 4/2019 | Melsheimer | E21B 10/633 |
| 10,301,880 | B2 * | 5/2019 | Bullock | E21B 7/28 |
| 10,584,537 | B2 * | 3/2020 | Bullock | E21B 10/26 |
| 2003/0106714 | A1 | 6/2003 | Smith et al. | |
| 2015/0014060 | A1 | 1/2015 | Wentworth et al. | |
| 2015/0075870 | A1 | 3/2015 | Cooper | |
| 2015/0233183 | A1 | 8/2015 | Melsheimer | |
| 2017/0342777 | A1 | 11/2017 | Cooper | |
| 2018/0313157 | A1 | 11/2018 | Langenfeld et al. | |

OTHER PUBLICATIONS

"Cable Pullers", http://www.drillhead.net/Drillhead.net/Pull_Back_Adapter_HDD.html, Drillhead, Inc (Publicly available at least as early as Aug. 22, 2018).

S. Naganawa, "Feasibility Study on Roller-cone Bit Wear Detection from Axial Bit Vibration", Journal of Petroleum Science and Engineering vol. 82-83 (2012), pp. 140-150.

* cited by examiner

PULLBACK SYSTEM FOR DRILLING TOOL

RELATED APPLICATIONS

This application claims the benefit of U.S. Provisional Patent Application No. 62/721,020 filed Aug. 22, 2018, the entire content of which is hereby incorporated by reference herein.

BACKGROUND

Horizontal directional drilling operations often use a rotary drill bit to drill a generally horizontal hole in the ground. The rotary drill bit is typically mounted at a distal end of a drill string including a plurality of drill rods (e.g., drill pipes) strung together end-to-end. The drill string transfers thrust and torque from a drive mechanism (e.g., an above-ground drive mechanism) to the rotary drill bit. In this way, the drill string is used to rotate the rotary drill bit about a longitudinal axis of the drill string and is concurrently used to apply thrust in a distal direction to the rotary drill bit. Horizontal directional drilling operations are described in more detail in U.S. Patent Application Publication Nos. US 2017/0044835 and US 2012/0118640, which are assigned to VERMEER MANUFACTURING COMPANY, and the disclosures of which are hereby incorporated by reference in their entireties.

Once the hole is complete, the drill string is pulled back through the hole so that product (e.g., cable, pipe, conduit, etc.) can be installed in the hole. To pull the product through the hole, the rotary drill bit, or at least a portion thereof, is often removed from the drill string to allow for the attachment of a pullback device that can connect with the product to install the product within the hole. However, this process can be time consuming and requires additional tooling to complete the pullback process for installing the product. Therefore, improvements are desired.

SUMMARY

The present disclosure relates generally to a pullback device for a rotary drill bit used for horizontal directional drilling operations. In one possible configuration, and by non-limiting example, a pullback device is removably secured to the rotary drill bit without having to remove the drill bit, or any portion thereof, from the drill string.

In one aspect of the present disclosure, a pullback system for installing product in a hole includes a rotary drill bit having a plurality of cutter elements, and a pullback device attachable to the rotary drill bit without disassembling the rotary drill bit or removing the rotary drill bit from a drill string. The pullback device includes a frame member and a plurality of anchor arms. Each anchor arm has a first end coupled to the frame member and a second end. Each anchor arm is configured to extend between adjacent cutter elements of the rotary drill bit. An attachment location can be used to attach product to the pullback device.

In another aspect of the present disclosure, a pullback device includes a frame member and a plurality of anchor arms, Each anchor arm is pivotally connected to the frame member at a first end, and has a second end configured to engage a rotary drill bit and to apply a pullback force to the rotary drill bit. Each anchor arm is configured to extend between adjacent cutter elements of the rotary drill bit and further includes a feature that includes a locking surface between the first end and the second end. The pullback device also includes a locking device insertable through an opening in the frame member. When inserted, the locking device has a first end that surrounds the locking surfaces of the anchor arms such that the plurality of anchor arms cannot pivot with respect to the frame member. The locking device also has a second end that includes an attachment location configured to attach a product to the pullback device.

In yet another aspect, a pullback system for installing product in a hole includes a rotary drill bit having a plurality of cutter cones, and a pullback device attachable to the rotary drill bit without disassembling the rotary drill bit or removing the rotary drill bit from a drill string. The pullback device includes a frame member, three anchor arms equally spaced about the frame member, each anchor arm having a first end pivotally coupled to the frame member and a second end configured to fit in an open gap between a drill bit base and adjacent cutter cones of the rotary drill bit. Each anchor arm has a feature that includes a locking surface between the first end and the second end. The pullback device further includes a locking device insertable through an opening in the frame member. When inserted, the locking device has a first end that surrounds the locking surfaces of the anchor arms such that the plurality of anchor arms cannot pivot with respect to the frame member. The locking device also has a second end that includes an attachment location configured to attach a product to the pullback device.

In another aspect of the present disclosure, a method of installing product in a hole includes using a rotary drill bit having a plurality of cutter cones to drill a hole; after completing the hole such that the rotary drill bit has traveled from a start location to an end location, installing a pullback device to the rotary drill bit at the end location, at least a portion of the pullback device being installed in open gaps between a drill bit base and adjacent cutter cones of the rotary drill bit; attaching a product to the pullback device at the end location; and pulling back the rotary drill bit through the hole from the end location to the start location, and detaching the product from the pullback device at the start location.

In another aspect of the present disclosure, a pullback device includes a frame member; a plurality of anchor arms, each anchor arm pivotally connected to the frame member at a first end, and having a second end that includes a claw configured to engage adjacent cutter cones of a rotary drill bit and to apply a radial pullback force to a rotation axis of each cutter cone, each anchor arm further having a feature that includes a locking surface between the first end and the second end; and a locking device insertable through an opening in the frame member, when inserted, the locking device having a first end that surrounds the locking surface of each anchor arm such that the plurality of anchor arms do not pivot with respect to the frame member, and the locking device having a second end that includes an attachment location configured to attach a product to the pullback device.

In another aspect of the present disclosure, a pullback device includes a frame member having an inner end that includes opposing attachment surfaces, and an outer end that includes an attachment location; and anchor arms, each anchor arm having an inner end configured to couple to an attachment surface of the frame member, and an outer end having an attachment location. In this example, portions of the frame member and the anchor arms are configured to engage adjacent cutter cones of a rotary drill bit, and to at least partially convert a pullback force $F_{PB}$ into a radial pullback force $F_{PBR}$ with respect to a cutter cone rotation axis.

In another aspect of the present disclosure, a pullback device includes a frame member; and a plurality of anchor arms, each anchor arm having a first end coupled to the frame member, and a second end that includes an attachment location. At least a portion of each anchor arm is configured to engage adjacent cutter cones of a rotary drill bit, and to at least partially convert a pullback force $F_{PB}$ into a radial pullback force $F_{PBR}$ with respect to a cutter cone rotation axis. In this example, the attachment locations are configured to attach a product to the pullback device such that the pullback device can pull the product in a hole.

In another aspect of the present disclosure, a system for drilling a hole and then installing product in the hole includes a rotary drill bit including a drill bit base adapted to be connected to the distal end of a drill string, the drill bit base defining a central axis about which the drill bit base is rotated during drilling, the drill bit base including a plurality of cutter cone mounting locations spaced circumferentially about the central axis, the rotary drill bit including cutter cones mounted at the cutter cone mounting locations, the cutter cones being mounted to rotate relative to the drill bit base about cutter cone axes, the cutter cone axes being oriented at oblique journal angles relative to the drill bit central axis, the cutter cones having conical cutting surfaces that encircle the cutter cone axes; a pullback device attachable to the rotary drill bit without disassembling the rotary drill bit or removing the rotary drill bit from the drill string, the pullback device having: a product attachment portion that aligns generally with the drill bit central axis when the pullback device is attached to the rotary drill bit, the product attachment portion being configured for attachment to the product desired to be installed in the hole; and an anchoring portion for securing the product attachment portion to the rotary drill bit, the anchoring portion being captured between the drill bit base and the conical cutting surfaces of the cutter cones when the pullback device is attached to the rotary drill bit.

In another aspect of the present disclosure, a method for pulling back product in a hole drilled by a drill string including a rotary drill bit having a drill bit base adapted to be connected to the distal end of the drill string, the drill bit base defining a central axis about which the drill bit base is rotated during drilling, the drill bit base including a plurality of cutter cone mounting locations spaced circumferentially about the central axis, the rotary drill bit including cutter cones mounted at the cutter cone mounting locations, the cutter cones mounted to rotate relative to the drill bit base about cutter cone axes, the cutter cone axes being oriented at oblique journal angles relative to the central axis, the cutter cones having conical cutting surfaces that encircle the cutter cone axes, the method comprising: pulling back the product by transferring a pullback load through the cutter cones such that the pullback load has first force vectors perpendicular to the cutter cone axes and second force vectors parallel to the cutter cone axes.

In another aspect of the present disclosure, a drill string for drilling and pulling back product in a hole includes a rotary drill bit having a drill bit base adapted to be connected to a distal end of the drill string, the drill bit base defining a central axis about which the drill bit base is rotated during drilling, the drill bit base including a plurality of cutter cone mounting locations spaced circumferentially about the central axis, the rotary drill bit further including cutter cones mounted at the cutter cone mounting locations, the cutter cones being mounted to rotate relative to the drill bit base about cutter cone axes, the cutter cone axes being oriented at oblique journal angles relative to the central axis, the cutter cones having conical cutting surfaces that encircle the cutter cone axes; and a pullback device having means to engage adjacent cutter cones and to convert a pullback force into a radial load on the cutter cone axes.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
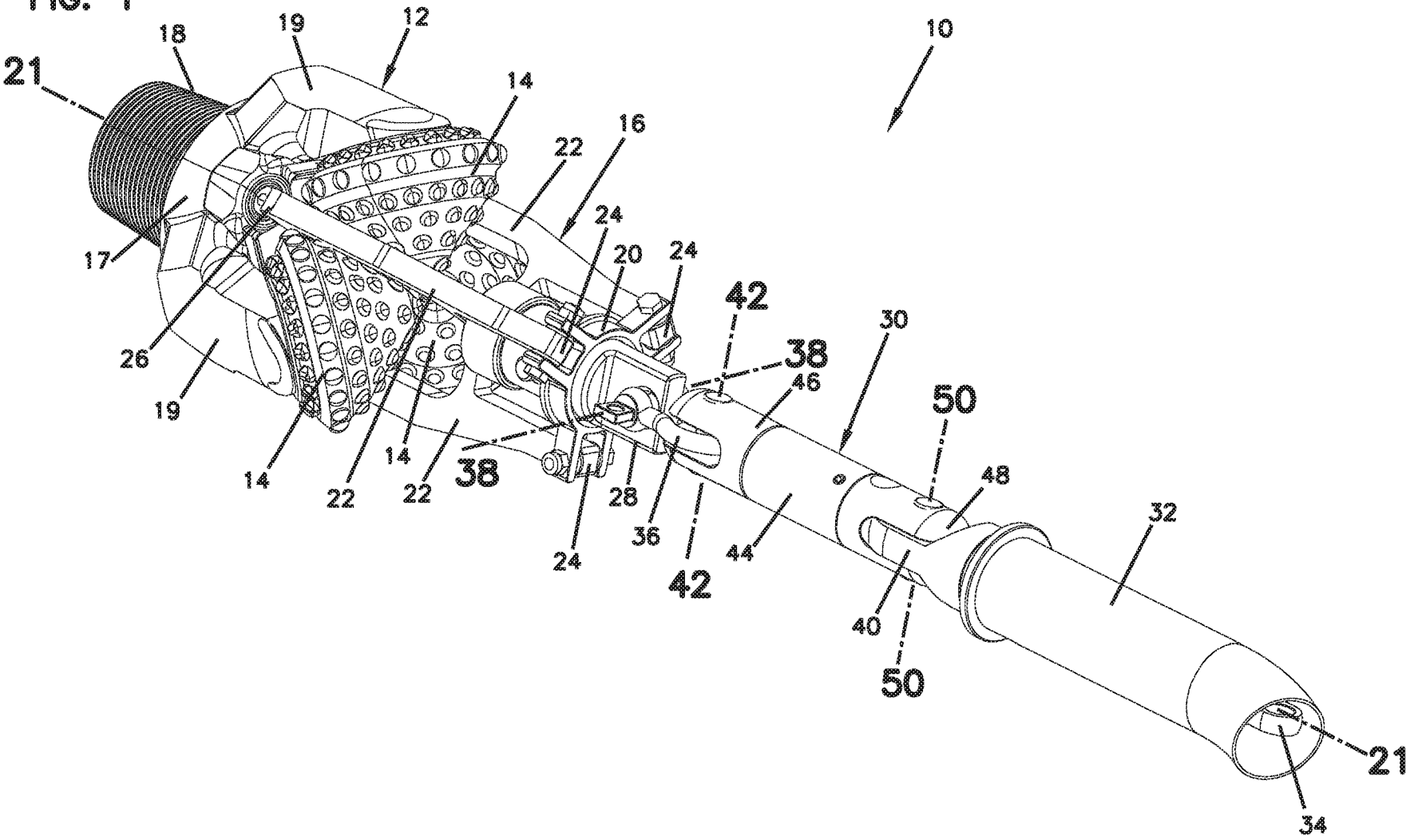
FIG. 1 is an isometric view of a pullback system.
Figure 2:
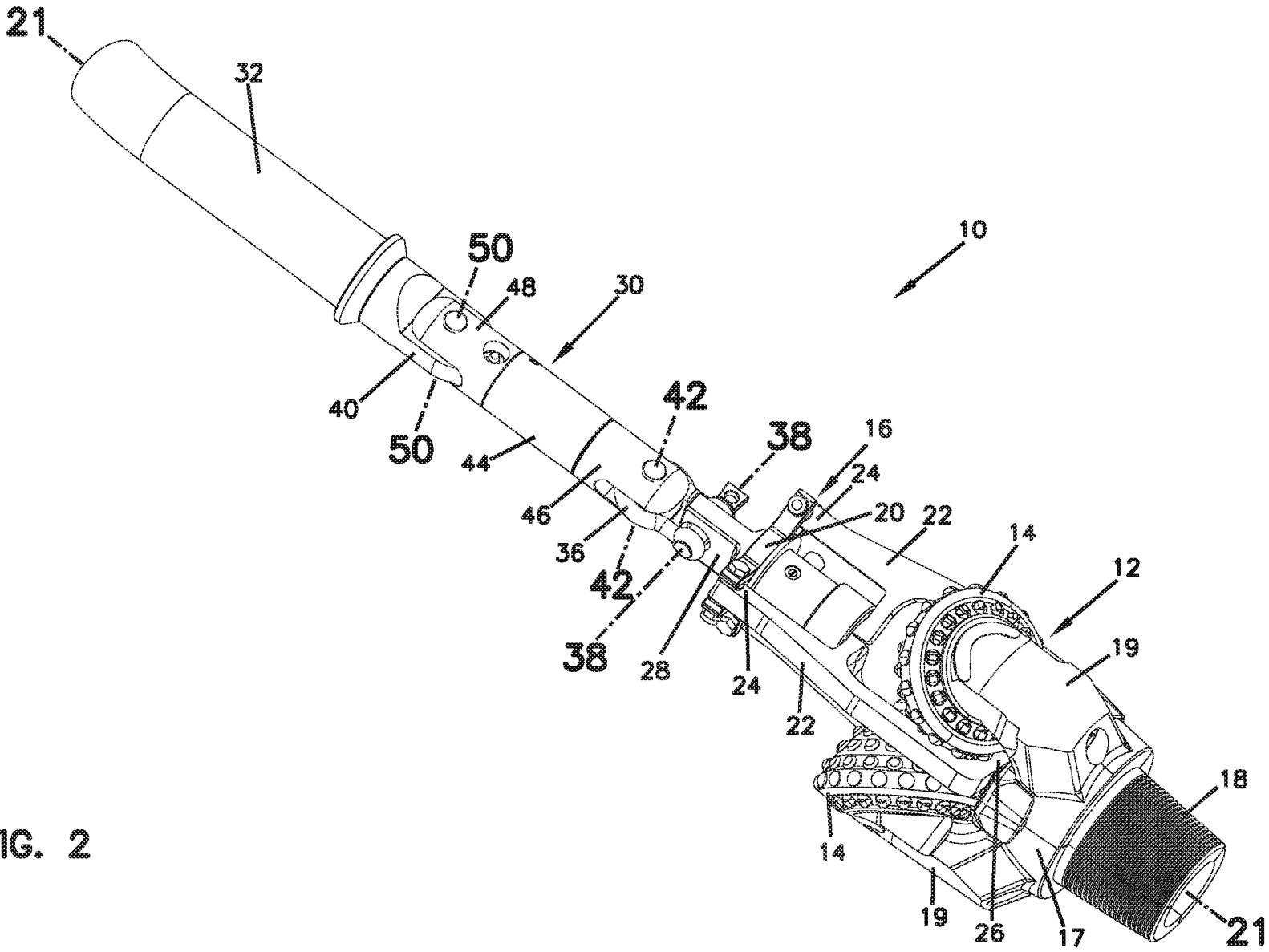
FIG. 2 is another isometric view of the pullback system of FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The present disclosure pertains to a pullback system for installing product in a hole. The pullback system includes a rotary drill bit having a plurality of cutter cones, and a pullback device attachable to the rotary drill bit without disassembling the rotary drill bit or removing the rotary drill bit from a drill string. Additionally, the pullback device does not require any specialized tools to attach to the rotary drill bit. This allows the pullback device to be quickly attached to the rotary drill bit so that product attached to the pullback device can be easily installed in a hole.

Figure 3:
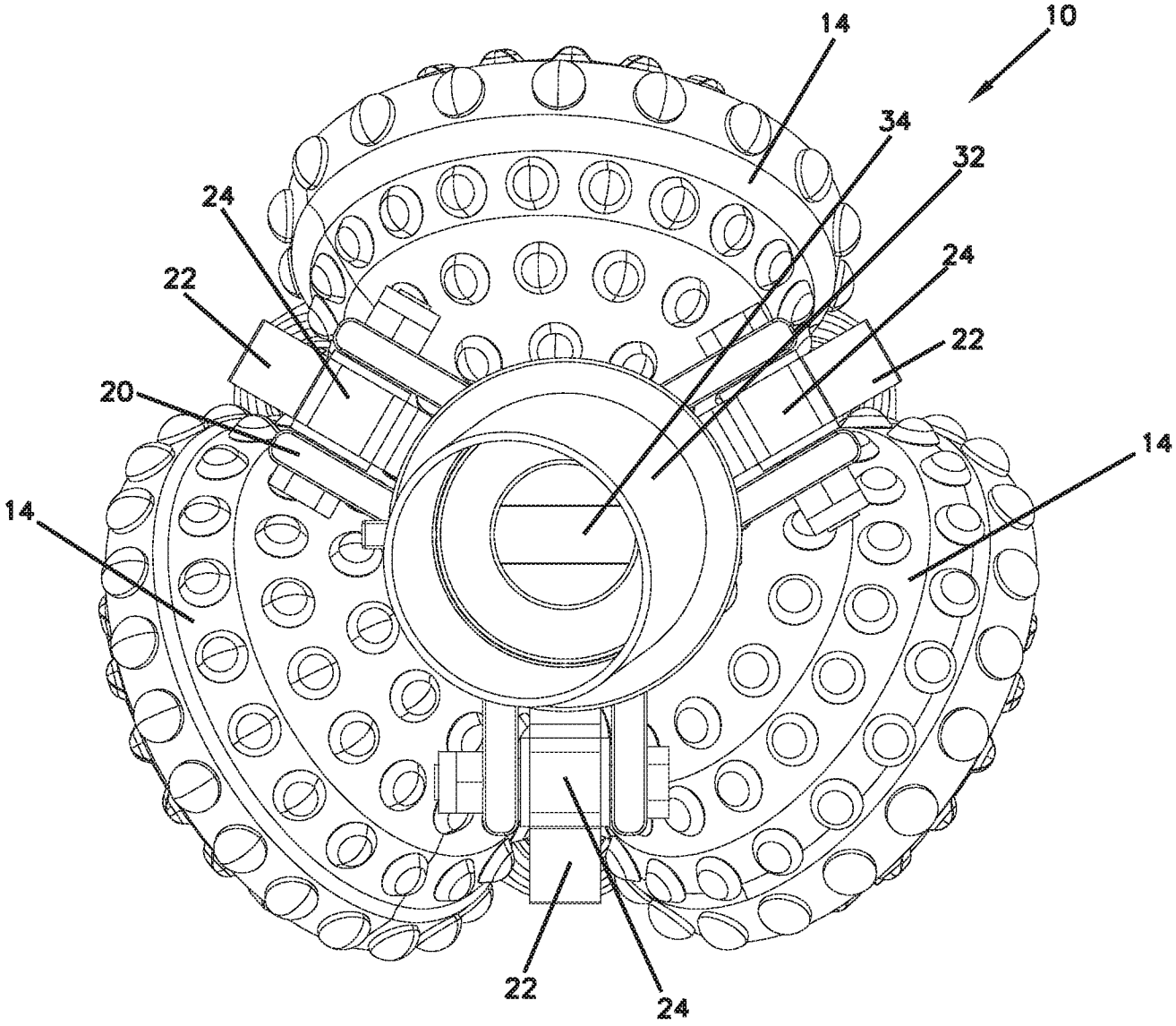
FIG. 3 is a front view of the pullback system of FIG. 1.
Figure 4:
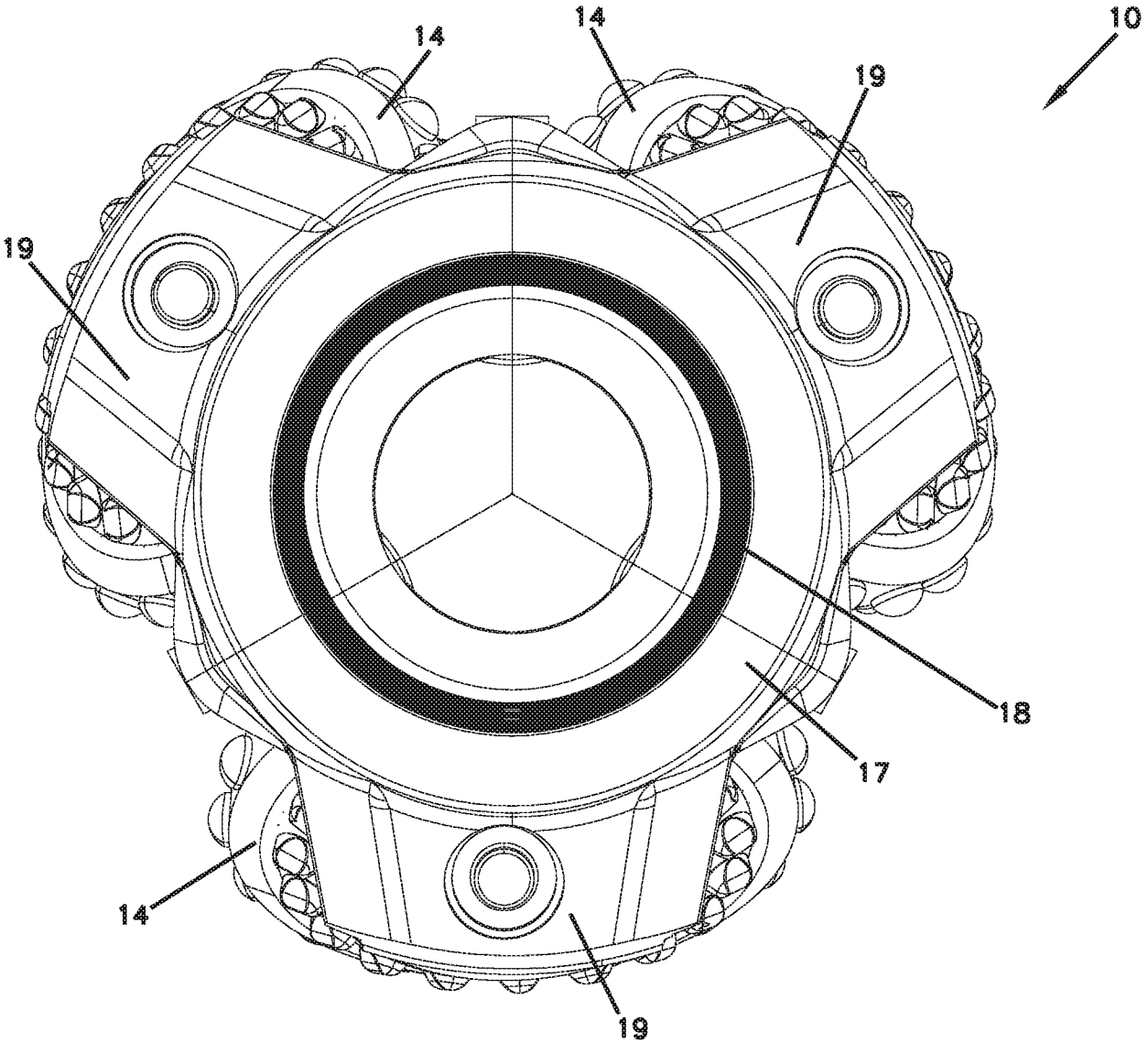
FIG. 4 is a rear view of the pullback system of FIG. 1.
Figure 5:
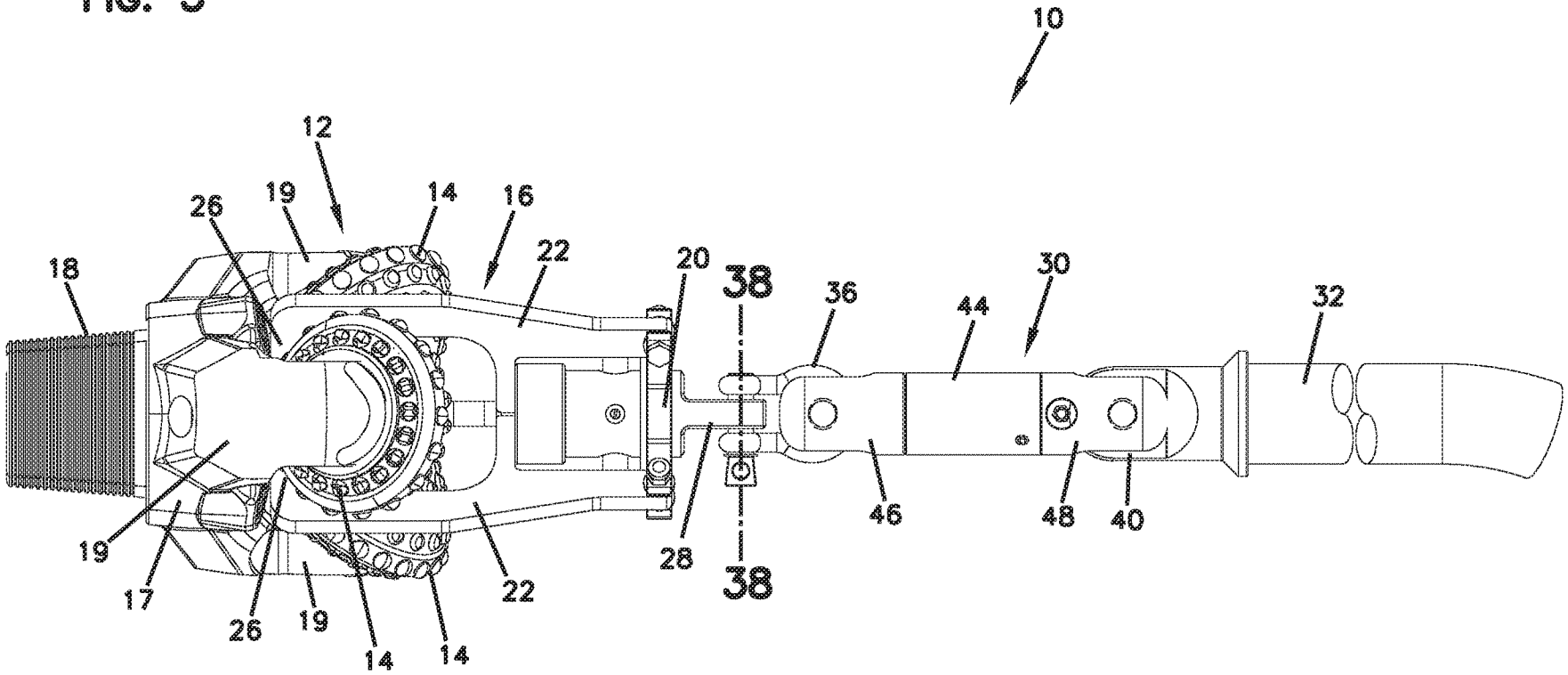
FIG. 5 is a side view of the pullback system of FIG. 1.
Figure 6:
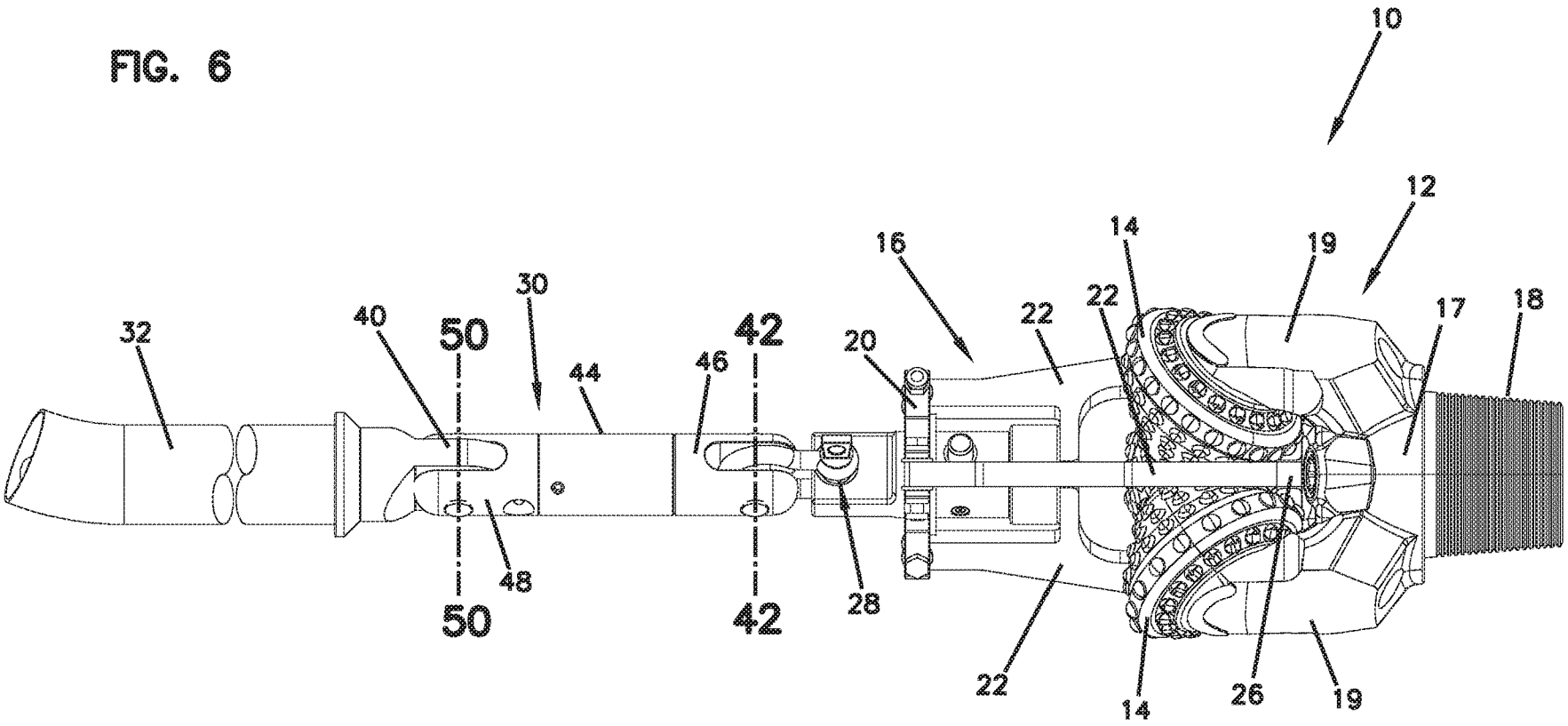
FIG. 6 is another side view of the pullback system of FIG. 1.

FIGS. 1-6 show isometric, front, rear, and side views, respectively of a pullback system 10. The pullback system 10 includes a rotary drill bit 12 having a plurality of cutter features or elements, which in the illustrated embodiments are cones 14. In other embodiments, the cutter features or elements can be the vanes, flutes, paddles, or blades of a drill bit, or other structure that operates to create the drilling action as the drill bit 12 rotates. In at least some examples, the rotary drill bit 12 can be used for horizontal directional drilling operations to drill generally horizontal holes in the ground. The rotary drill bit 12, in addition to the cutter cones 14, includes a drill bit base 17, a mount 18, and cutter arms 19 that each extend from the drill bit base 17. Each cutter cone 14 is attached to a cutter arm 19, and each cutter cone 14 has conical cutting surfaces that encircle a rotation axis C-C of each cutter cone (shown in FIG. 7). As shown in FIG. 3, the conical cutting surfaces of adjacent cutter cones 14 oppose each other. In the example shown in FIGS. 1-6, the rotary drill bit 12 includes three cutter cones 14 which are circumferentially spaced 120 degrees relative to one another about a drill bit central axis 21.

In the examples described and depicted herein, the rotary drill bit 12 is a tri-cone drill bit. Tri-cone drill bits are often used for drilling operations in rocky ground conditions. Tri-cone drill bits can be configured in various ways, and thus the description and figures included herein describe just some of the many examples in which the rotary drill bit 12 can be configured for use with the pullback system 10.

The mount 18 can be used to mount the rotary drill bit 12 to the distal end of a drill string that includes a drill head and a plurality of drill rods strung together end-to-end. In the example shown in FIGS. 1-6, the mount 18 has a threaded surface such that the rotary drill bit 12 can be threaded onto the distal end of a drill string. The drill rods can transfer torque and thrust from a drive mechanism to the rotary drill bit 12 such that the rotary drill bit 12 can rotate about the central axis 21 and thrust in the direction of the cutter cones 14 which allows the cutter cones 14 to remove debris (e.g., rock, dirt, mud etc.) during a drilling operation.

The rotary drill bit 12 can be used on various drill rod drilling systems. In a preferred embodiment, the rotary drill bit 12 is used on a dual drill rod drilling system. Dual drill rod drilling systems are typically used for directional drilling, and typically include an inner rod and an outer rod. A typical dual rod drilling system is generally configured to drive into the ground a series of drill rods joined end-to-end to form a drill string. At the end of the drill string is a drill bit (e.g., the rotary drill bit 12). A dual rod drilling system typically includes a first drive mechanism that controls rotation of the drill bit and a second drive mechanism that controls rotation of a steering element.

When a straight hole is drilled with a dual rod drilling system, the first and second drive mechanisms are concurrently operated such that both the drill bit and the steering element are rotated as the drill string is thrust into the ground.

When a directional change is needed, because the steering element is axially misaligned with the drill string, the drive mechanism that controls the steering element is stopped and the drill string is thrust further into the ground while the drive mechanism that controls the drill bit is rotated. This causes the drill bit to deviate from a straight path and follow the direction dictated by the steering element. A dual drill rod drilling system is described in more detail in U.S. patent application Ser. No. 15/967,948, filed May 1, 2018, assigned to VERMEER MANUFACTURING COMPANY, the disclosure of which is hereby incorporated by reference in its entirety.

A pullback device 16 is attachable to the rotary drill bit 12 without disassembling the rotary drill bit 12 or removing the rotary drill bit 12 from the drill string. Additionally, the pullback device 16 does not require any specialized tools to attach to the rotary drill bit 12. This allows the pullback device 16 to be quickly attached to the rotary drill bit 12 during a pullback operation.

A pullback operation generally occurs after the horizontal directional drilling operation is completed. A trench can be dug into the ground at the end of the hole so that product can be attached to the pullback device 16, and the pullback device 16 can be attached to the rotary drill bit 12. Thereafter, the rotary drill bit 12 (and the pullback device 16 and the product attached thereto) is pulled back through the hole. In some examples, a reaming operation is performed when the rotary drill bit 12 is pulled back through the hole for increasing the diameter of the hole. In such examples, the horizontal directional drilling operation drills a pilot hole, and thereafter, one or more additional cutters can be added to the rotary drill bit 12 to increase the diameter of the pilot hole when the rotary drill bit 12 is pulled back through the hole. In some examples, the rotary drill bit 12 is pulled back through the hole without a reaming operation. Once the rotary drill bit 12 is pulled out of the hole, the product can be detached from the pullback device 16, thereby leaving the product installed inside the hole.

The pullback device 16 includes a frame member 20 and a plurality of anchor arms 22. Each anchor arm 22 has a first end 24 coupled to the frame member 20, and a second end 26 configured to engage the cutter cones 14 of the rotary drill bit 12.

The second end 26 of each anchor arm 22 can transfer a pullback force from the pullback device 16 (e.g., in the direction that the pullback device 16 is pulled through the hole) into a radial pullback force with respect to the rotation axis of each cutter cone 14. This can help to prevent the cutter cones 14 from being pulled off of their respective bearings during the pullback operation. The pullback device 16 can also include a product attachment portion 28 that aligns generally with the drill bit central axis 21 when the pullback device 16 is attached to the rotary drill bit 12, the product attachment portion 28 can be attached to the product desired for installation in the hole.

In the example depicted in FIGS. 1-6, the product attachment portion 28 is used to attach the pullback device 16 to a swivel device 30 via a first link 36 such that the swivel device 30 can pivot about a first axis 38 and about a second axis 42 with respect to the pullback device 16. The swivel device 30 is attached to a product attachment section 32 via a second link 40 such that the swivel device 30 can pivot about a third axis 50 with respect to the product attachment section 32. The product attachment section 32 has a connector 34 for attaching product to the product attachment section 32. The product attachment section 32 aligns generally with the drill bit central axis 21 when the pullback device 16 is attached to the rotary drill bit 12.

The swivel device 30 includes a center component 44 that allows a first half 46 of the swivel device 30 to rotate along with the pullback device 16 (and rotary drill bit 12 attached thereto), while preventing a second half 48 of the swivel device 30 from rotating along with the pullback device 16. Thus, the swivel device 30 can prevent the product from rotating about the central axis 21 of the rotary drill bit 12 inside the hole when the pullback device 16 is pulled back through the hole.

In the example shown in FIGS. 1-6, each anchor arm 22 can fit in an open gap between the drill bit base 17 and adjacent cutter cones 14. Each anchor arm 22 is configured to extend between adjacent cutter elements (e.g., adjacent cutter cones 14) of the rotary drill bit 12. As illustrated, the anchor arms 22 are configured to extend between adjacent cutter cones 14 of the rotary drill bit 12 in a direction parallel to the drill bit central axis 21. The plurality of anchor arms 22 are equally spaced between the cutter cones 14. In some examples, the number of anchor arms 22 on the pullback device 16 is equal to the number of cutter cones 14 on the rotary drill bit 12. In other examples, the number of anchor arms 22 is less than the number of cutter cones 14, and in certain examples the number of anchor arms 22 is half of the number of cutter cones 14. FIGS. 1-6 show the pullback device 16 having three anchor arms 22 equally spaced between the cutter cones 14 of the rotary drill bit 12, however, the pullback device 16 can have fewer than three anchor arms 22, or more than three anchor arms 22 as may be needed or desired for a particular application.

In some examples, the anchor arms 22 of the pullback device 16 are part of an anchoring portion that can secure the product attachment portion 28 to the rotary drill bit 12. As shown in FIGS. 1-6, the anchoring portion is captured between the drill bit base 17 and the conical cutting surfaces of the cutter cones 14 when the pullback device 16 is attached to the rotary drill bit 12. In such examples, the anchor arms 22 are radial portions that fit within the open gaps between the drill bit base 17 and the opposing conical cutting surfaces of adjacent cutter cones 14. In some examples, the anchoring portion includes three radial portions circumferentially spaced 120 degrees relative to one another. In some examples, the anchoring portion includes first, second, and third radial anchor arms 22 that respectively fit within first, second, and third open gaps defined circumferentially between the cutter cones 14 of the rotary drill bit 12.

Figure 7:
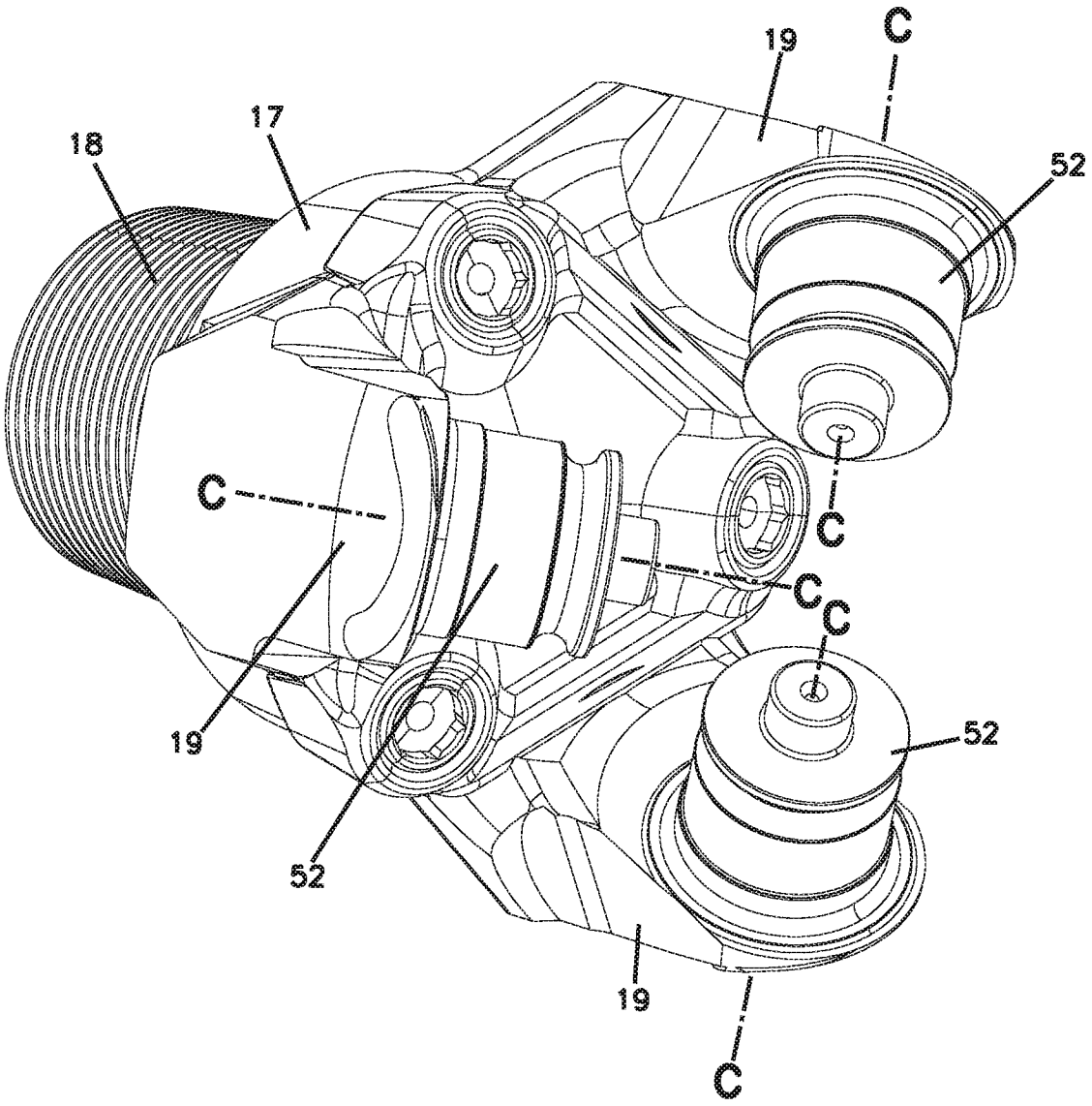
FIG. 7 is an isometric view of a rotary drill bit with cutter cones removed.

FIG. 7 is an isometric view of the rotary drill bit 12 with the cutter cones 14 removed therefrom. As shown in FIG. 7, each cutter arm 19 has a cutter cone mounting location 52. The cutter cone mounting locations 52 are spaced circumferentially about the drill bit central axis 21. Each cutter cone 14 can be mounted to a cutter cone mounting location 52 by various bearings such as ball bearings, roller bearings, thrust bearings, etc. Each cutter cone mounting location 52 defines a cutter cone rotation axis C-C. The cutter cone rotation axes C-C are oriented at oblique journal angles relative to the drill bit central axis 21, and the cutter cones 14 are mounted to rotate relative to the drill bit base 17 about the cutter cone rotation axes C-C. As shown in FIGS. 1-6, each cutter cone 14 has conical cutting surfaces that encircle each cutter cone rotation axis.

Figure 8:
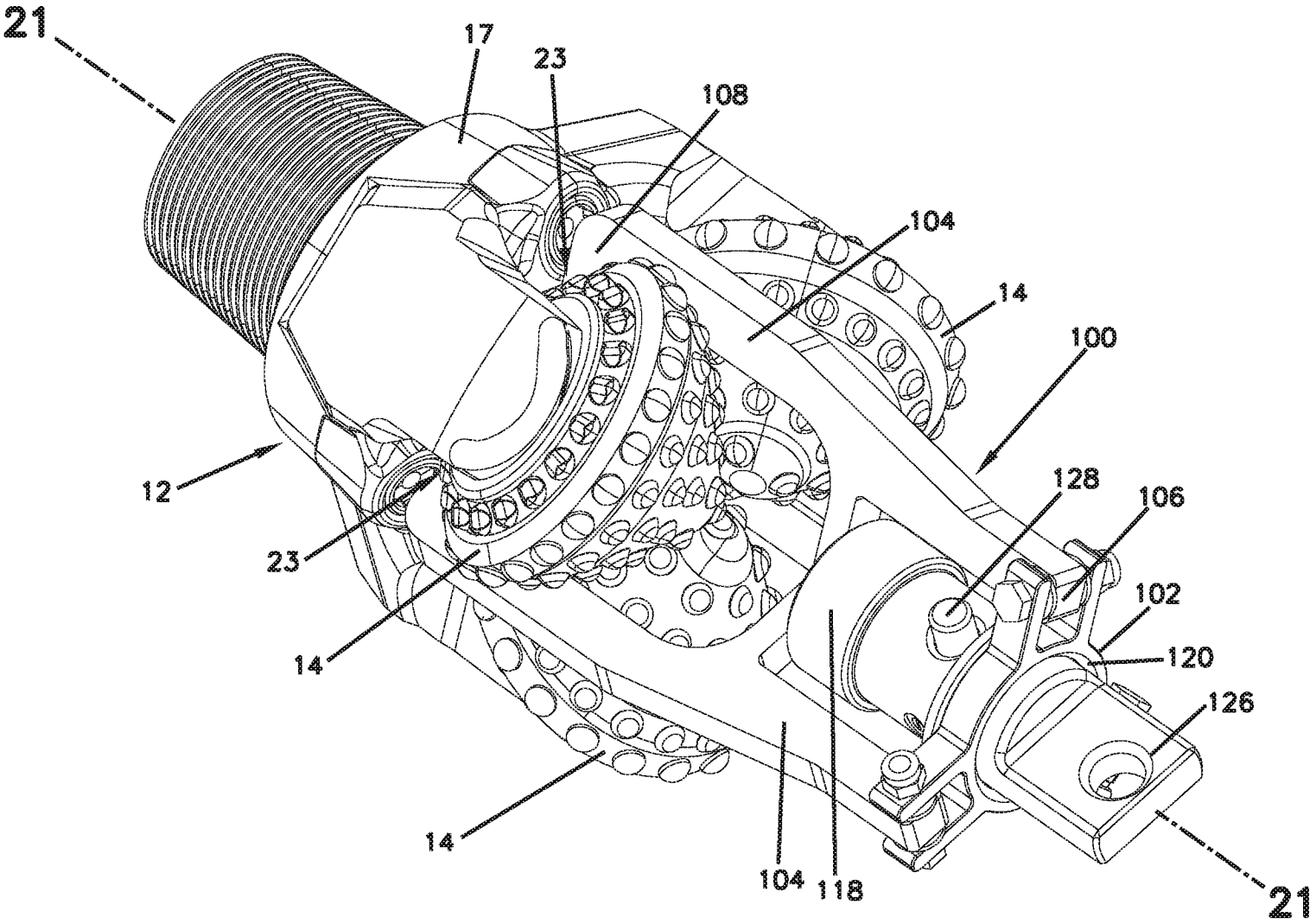
FIG. 8 is an isometric view of a pullback device in a constricted position and attached to a rotary drill bit.
Figure 9:
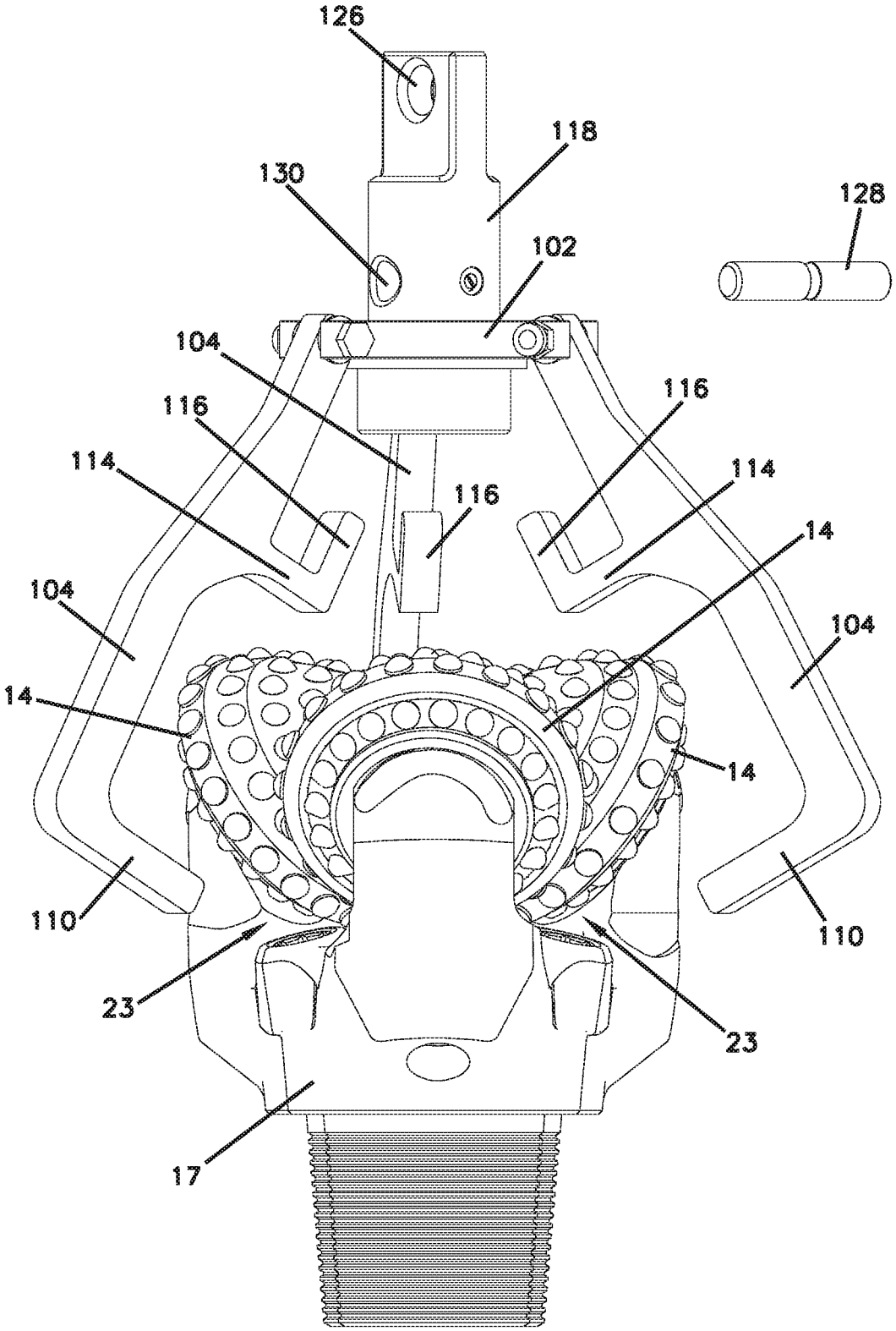
FIG. 9 is a view of the pullback device of FIG. 8 in an expanded position.
Figure 10:
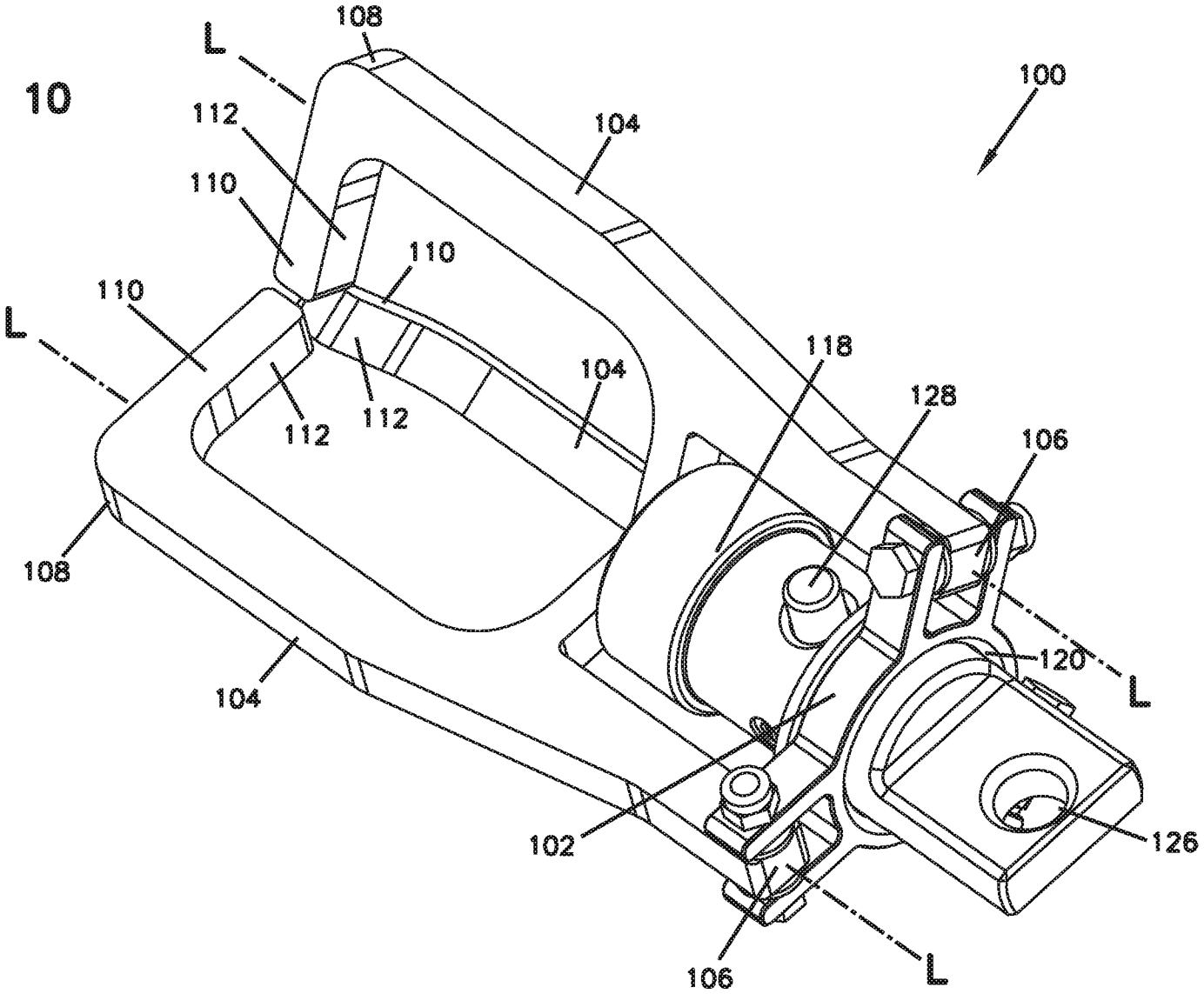
FIG. 10 is an isometric view of the pullback device of FIG. 8.
Figure 11:
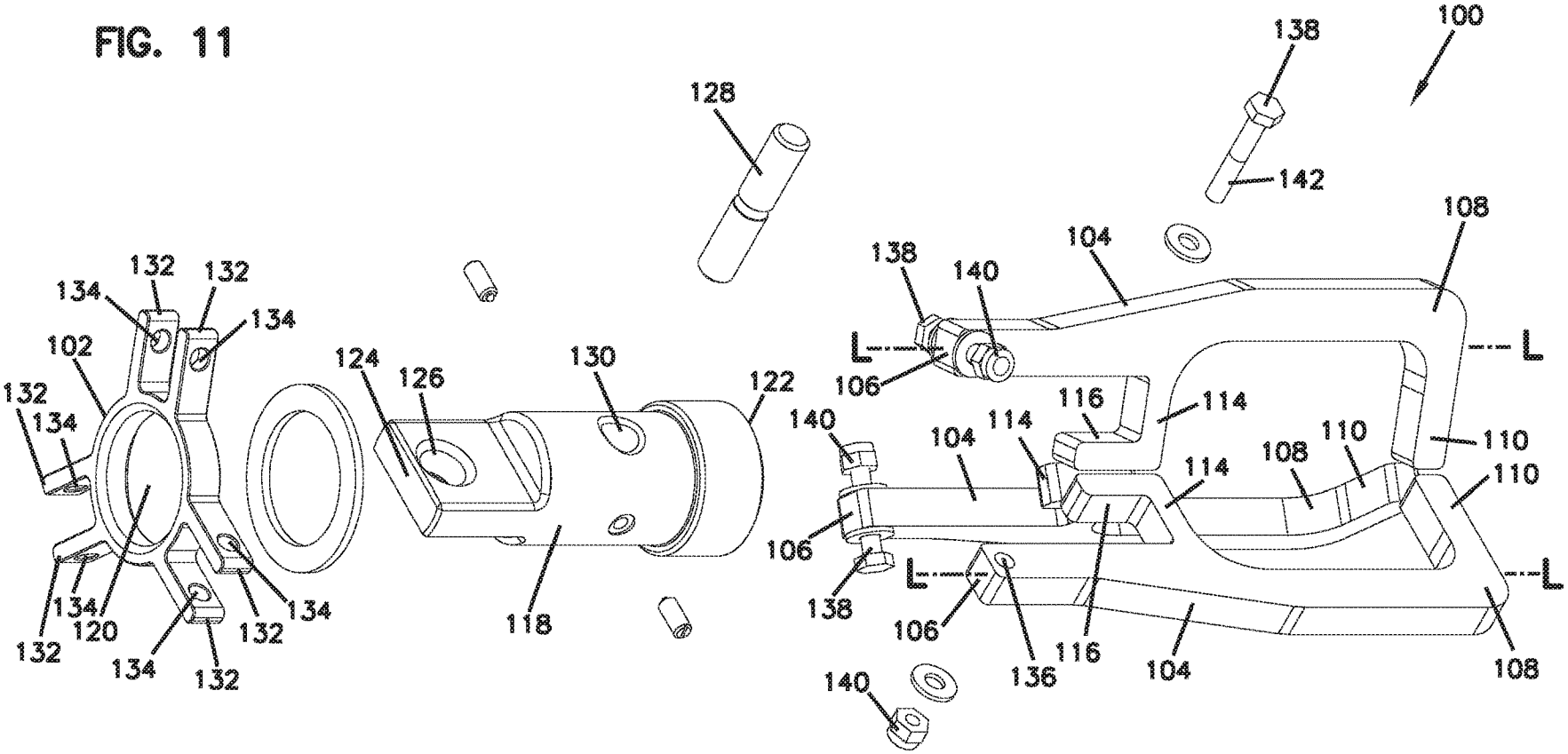
FIG. 11 is an exploded isometric view of the pullback device of FIG. 8.

FIG. 8 is an isometric view of a pullback device 100 in a constricted position and attached to the rotary drill bit 12. FIG. 9 is a view of the pullback device 100 in an expanded position and placed next to the rotary drill bit 12. FIG. 10 is an isometric view of the pullback device 100 in the constricted position, and FIG. 11 is an exploded view of the pullback device 100. As shown in FIGS. 8-11, the pullback device 100 includes a frame member 102 and a plurality of anchor arms 104 attached thereto. Each anchor arm 104 is pivotally connected to the frame member 102 at a first end 106, and has a second end 108 that includes a claw 110 that can engage the cutter cones 14 of the rotary drill bit 12. The anchor arms 104 are pivotally moveable relative to the frame member 102 between an expanded position (shown in FIG. 9) where the anchor arms 104 can be opened over the rotary drill bit 12 so that the claws 110 can be fitted within the open gaps 23 between the drill bit base 17 and the cutter cones 14, and a constricted position where the anchor arms 104 are locked such that the anchor arms 104 are prevented from pivoting with respect to the frame member 102. When in the constricted position, the claws 110 can be secured within the open gaps 23 such that the claws 110 do not lose their grip on the cutter cones 14 during a pullback operation. As shown in FIGS. 9 and 10, each claw 110 has a radial projection surface 112 that is substantially orthogonal to the drill bit central axis 21 such that the radial projection surfaces 112 can fit in the open gaps 23 between the drill bit base 17 and the cutter cones 14.

In some examples, the number of anchor arms 104 on the pullback device 100 is equal to the number of cutter cones 14 on the rotary drill bit 12. For example, FIG. 8 shows the pullback device 100 having three anchor arms 104 equally spaced circumferentially around the frame member 102, each anchor arms 104 inserted between two adjacent cutter cones 14 of the rotary drill bit 12. In other examples, there can be fewer anchor arms 104 than cutter cones 14, and in certain examples the number of anchor arms 104 is half the number of cutter cones 14. Thus, the pullback device 100 can have fewer than three anchor arms 104, or more than three anchor arms 104 as may be needed or desired for a particular application.

As shown in FIGS. 9 and 11, each anchor arm 104 also includes a feature 114 between the first end 106 and the second end 108. In the example depicted, the feature 114 of each anchor arm 104 includes a locking surface 116 that is substantially parallel to a longitudinal axis L-L of each anchor arm 104. In the example shown in FIGS. 9 and 11, the feature 114 has the shape of an elbow.

As shown in FIGS. 8-11, a locking device 118 insertable through an opening 120 in the frame member 102. The locking device 118 has a hollow cylindrical body that is open on a first end 122 and closed on a second end 124. In some examples, the locking device 118 is a collar. When the locking device 118 is not inserted in the opening 120, the anchor arms 104 are pivotable with respect to the frame member 102 such that the claws 110 can engage and disengage adjacent cutter cones 14 of the rotary drill bit 12. When the locking device 118 is inserted through the opening 120, a first end 122 of the locking device 118 surrounds the feature 114 of each anchor arm 104 such that the plurality of anchor arms 104 are prevented from pivoting with respect to the frame member 102. Also, the locking device 118 has a second end 124 that includes an attachment location 126 configured to attach product to the pullback device 100.

In some examples, the pullback device 100 includes a pin 128, and the locking device 118 includes a bore 130 between the first end 122 and the second end 124 of the locking device 118. The pin 128 is insertable in the bore 130 for restraining the locking device 118 within the opening 120 of the frame member 102.

As shown in FIG. 11, the frame member 102 includes extension members 132, each having a bore 134, while the first end 106 of each anchor arm 104 also includes a corresponding bore 136. When assembled, the first end 106 of each anchor arm 104 is slotted between a pair of extension members 132 such that the bore 136 of the anchor arm 104 aligns with the bores 134 of the extension members 132. A free end 142 of bolt 138 is insertable through the bores 134 and bores 136, and a nut 140 can be attached to the free end 142 (e.g., by screwing the nut 140 onto the free end 142) to secure each anchor arm 104 to the frame member 102, and thereby allow each anchor arm 104 to pivot with respect to the frame member 102 about each bolt 138. The number of pairs of extension members 132 may correspond to the number of anchor arms 104.

In some examples, the locking device 118 is an axial attachment anchor arm that is part of a product attachment portion of the pullback device 100, and that aligns with the central axis of the rotary drill bit 12 when the pullback device 100 is attached to the rotary drill bit 12, and that can be used to couple product to the first, second, and third radial anchor arms 104.

In the example shown in FIGS. 8-11, the attachment location 126 is an eyelet. In some examples, the attachment location 126 is used to attach the pullback device 100 to a swivel device (e.g., such as the swivel device 30 shown in FIGS. 1-6). The swivel device can attach product to the pullback device 100 and prevent the product from rotating when the pullback device 100 is pulled back through the hole.

Figure 12:
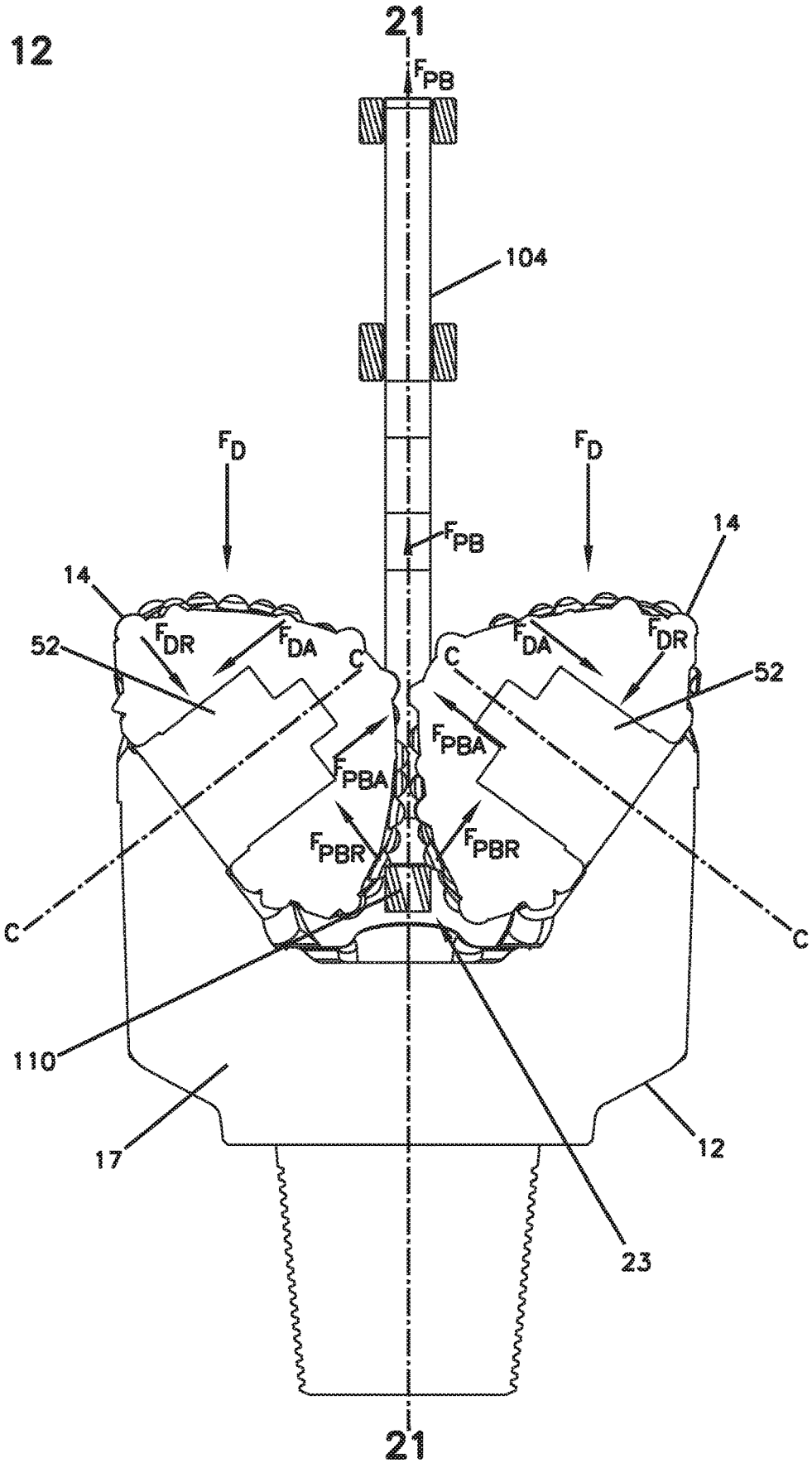
FIG. 12 is a cross-sectional view of the pullback device of FIG. 8 attached to a rotary drill bit.

FIG. 12 is a cross-sectional view of the pullback device 100 attached to the rotary drill bit 12. As shown in FIG. 12, the claw 110 of an anchor arm 104 engages adjacent cutter cones 14 of the rotary drill bit 12. During drilling, a drilling force $F_D$ is generated. During pullback, a pullback force $F_{PB}$ is generated in a direction opposite the drilling force $F_D$, where both the pullback force $F_{PB}$ and the drilling force $F_D$ are substantially parallel to the drill bit central axis 21. As used herein, "substantially parallel" includes tolerances of up to 5 degrees. During drilling, the drill string is in compression and the drilling force $F_D$ is a compressive load whereas, during pullback, the drill string is in tension and the pullback force $F_{PB}$ is a tensile load.

Due to each cutter cone mounting location 52 defining a cutter cone rotation axes C-C that is oriented at an oblique journal angle relative to the drill bit central axis 21, the drilling force $F_D$ includes both an axial drilling force component $F_{DA}$ and a radial drilling force component $F_{DR}$. During pullback, the claw 110 of each anchor arm 104 engages adjacent cutter cones 14 such that the claw 110 at least partially converts the pullback force $F_{PB}$ into an axial pullback force component $F_{PBA}$ and a radial pullback force component $F_{PBR}$ with respect to each cutter cone rotation axes C-C. Thus, the pullback force $F_{PB}$ is not a pure axial force, but rather the pullback force $F_{PB}$ is a resultant force of the axial pullback force component $F_{PBA}$ and the radial pullback force component $F_{PBR}$. The resultant pullback force $F_{PB}$ has a larger magnitude than the individual axial pullback force component $F_{PBA}$ and the radial pullback force component $F_{PBR}$. Thus, the magnitude of the axial pullback force component $F_{PBA}$ (the force vector that would tend to pull the cutter cones 14 off from the drill bit base 17) is less than the magnitude of the pullback force $F_{PB}$. This is advantageous to prevent the cutter cones 14 from being pulled off of the drill bit base 17 during pullback.

Figure 13:
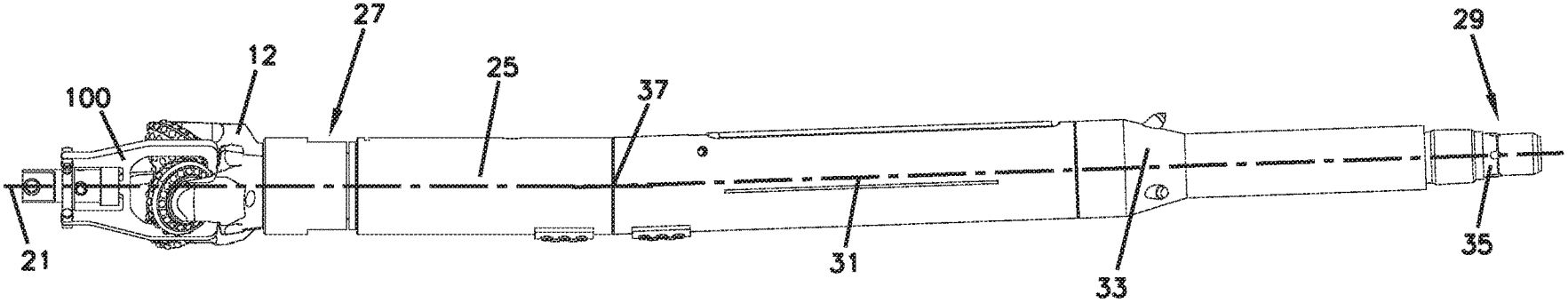
FIG. 13 is a side view of the pullback device of FIG. 8 attached to a rotary drill bit, and the rotary drill bit attached to a drill head.

FIG. 13 is a side view of the pullback device 100 attached to the rotary drill bit 12, and the rotary drill bit 12 attached to a drill head 25. The drill head 25 includes a downhole end 27 and an up-hole end 29. As shown in FIG. 13, the rotary drill bit 12 is attached to the drill head 25 at the downhole end 27. The drill head 25 is connectable at the up-hole end 29 to the outer drill rods and inner drill rods of a drill string, such as the drill string 902 shown in FIG. 30, of a dual drill rod drilling system. For example, the drill head 25 can include an outer rod adapter 33 to connect the drill head 25 to an outer drill rod and an inner rod coupling 35 to connect the drill head 25 to an inner drill rod. The drill head 25 includes a drill rod axis 31 that has a bend (e.g., at boundary 37) relative to the drill bit central axis 21. On some examples, the bend of the drill rod axis 31 relative to the drill bit central axis 21 is approximately 2 degrees. The construction of the drill head 25 is such that the drill head 25 is designed to withstand a higher pullback force than the pullback device 100. Accordingly, the pullback device 100 is designed to fail and/or yield before damaging the drill head 25 during a pullback operation.

Figure 14:
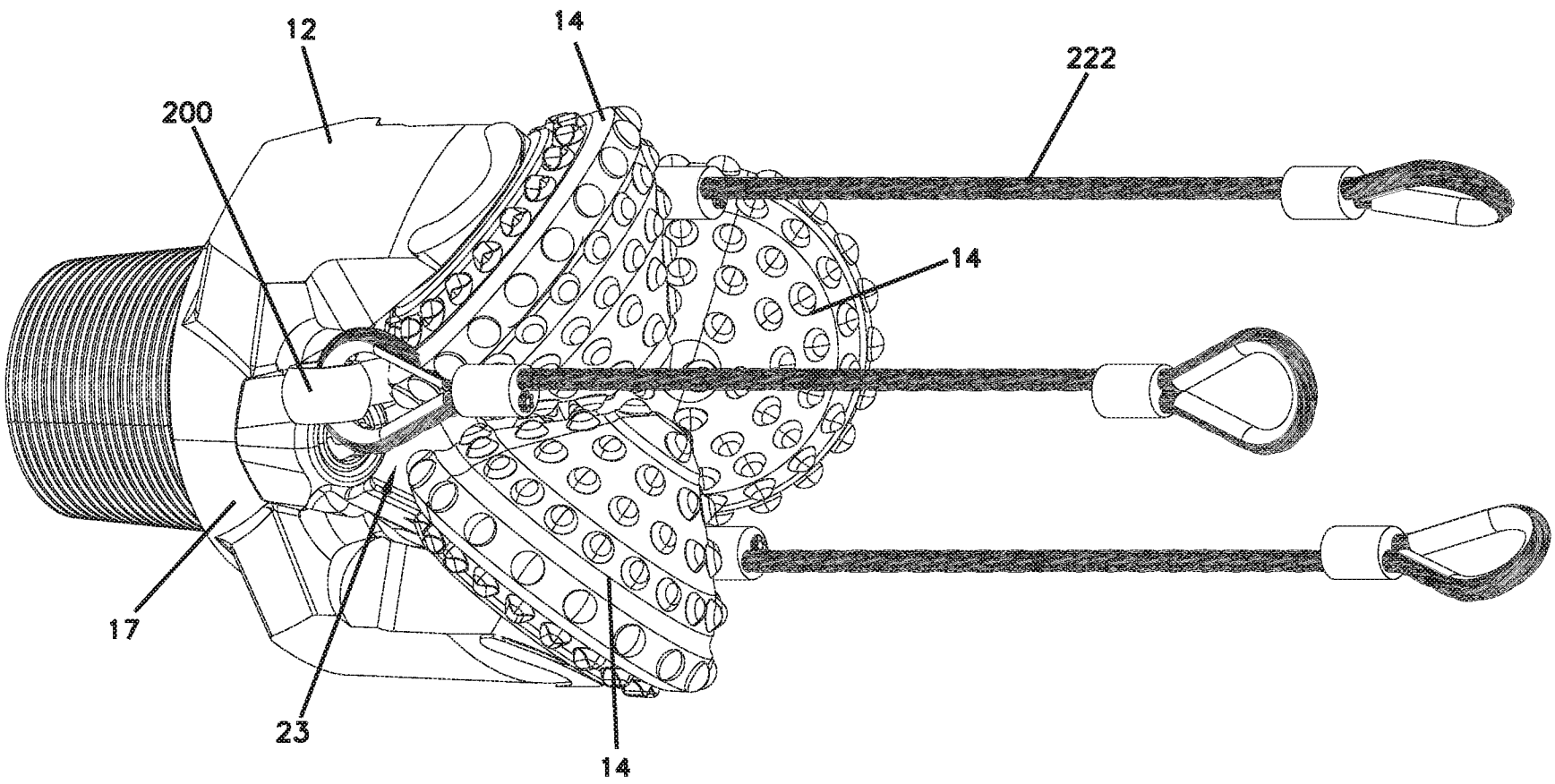
FIG. 14 is an isometric view of another example of a pullback device attached to a rotary drill bit.
Figure 15:
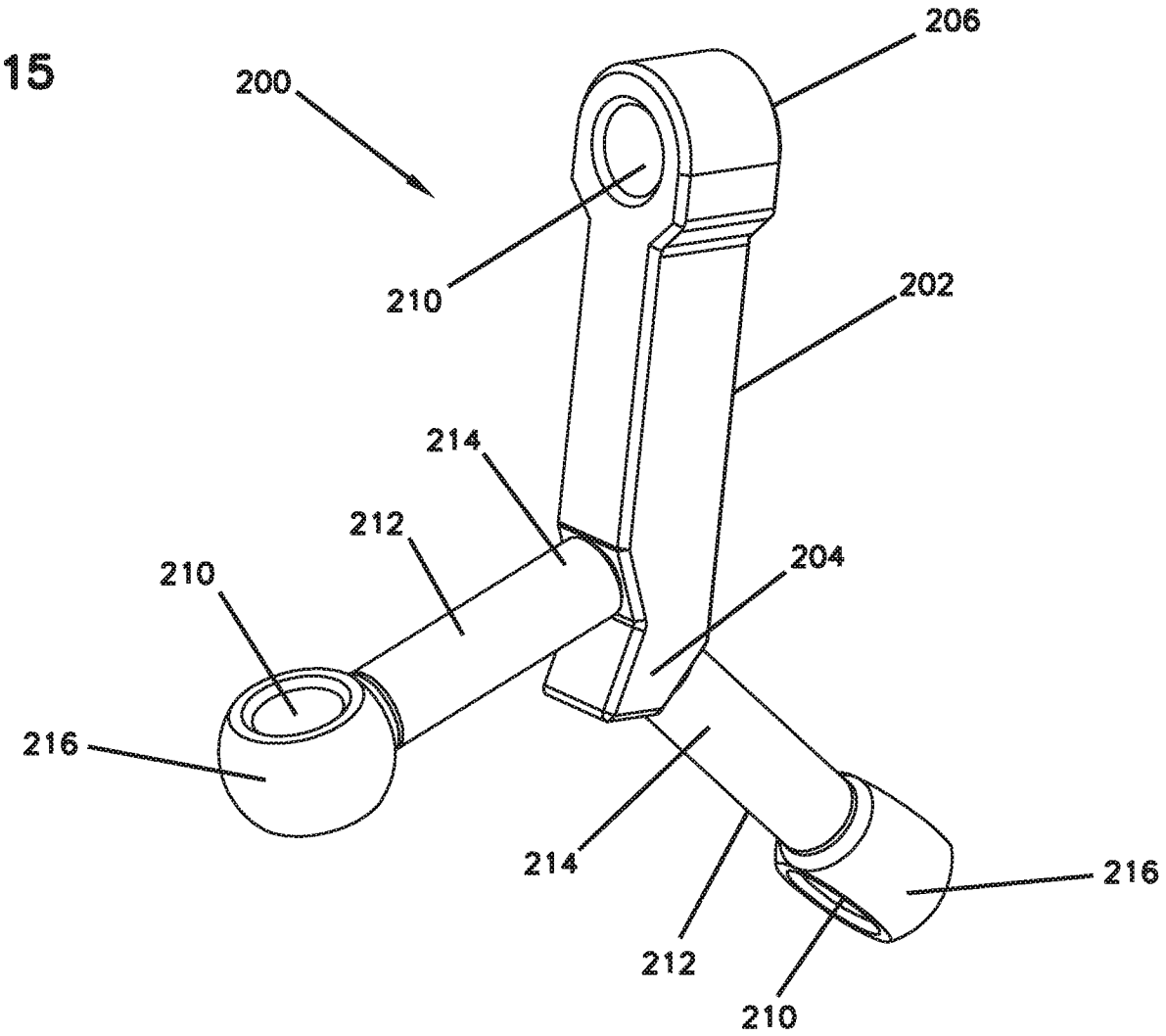
FIG. 15 is an isometric view of the pullback device of FIG. 14.
Figure 16:
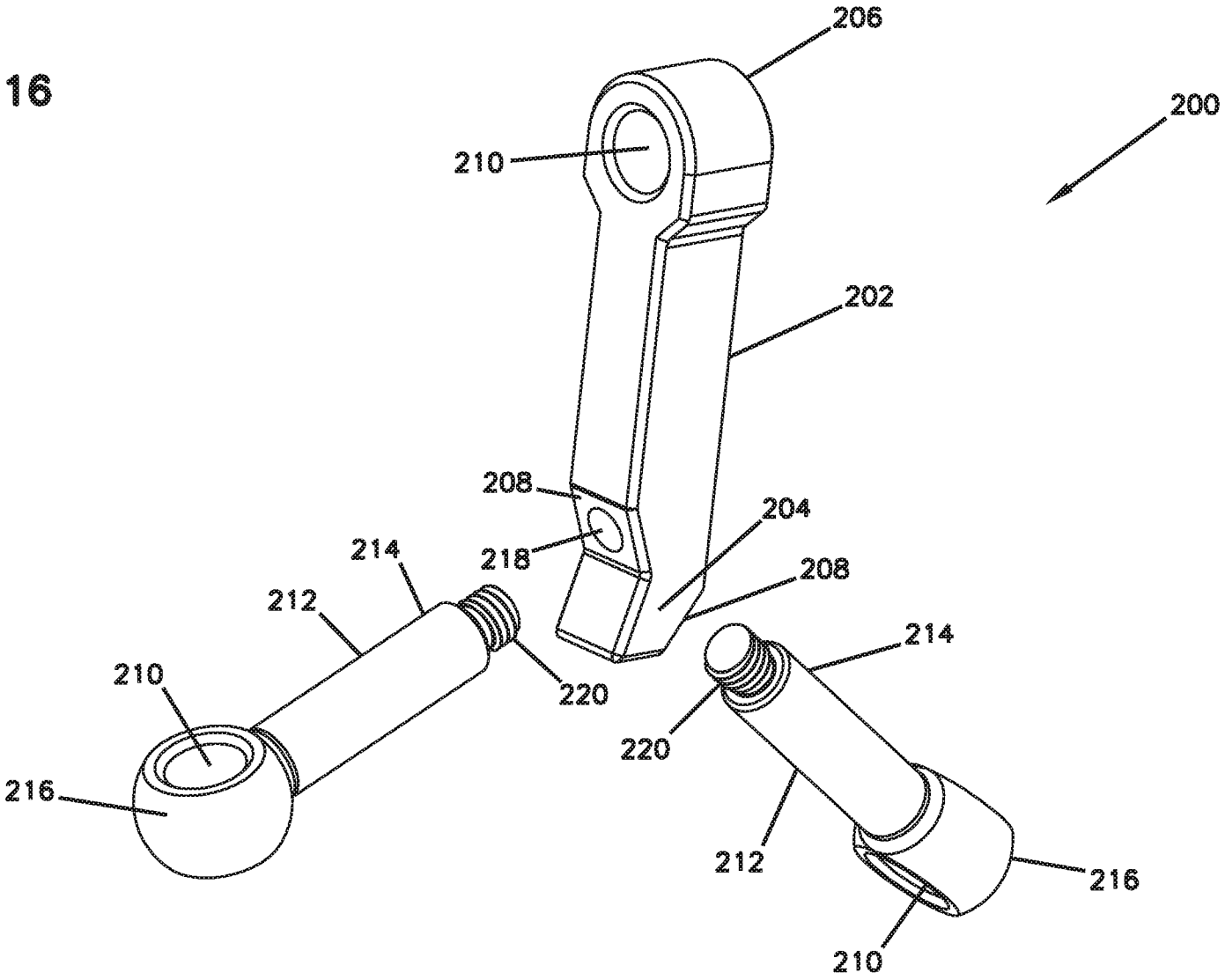
FIG. 16 is an exploded isometric view of the pullback device of FIG. 14.

FIG. 14 is an isometric view of a pullback device 200 attached to the rotary drill bit 12. FIG. 15 is an isometric view of the pullback device 200, and FIG. 16 is an exploded view of the pullback device 200. The pullback device 200 is attachable to the rotary drill bit 12 without disassembling the rotary drill bit 12 or removing the rotary drill bit 12 from a drill string.

As shown in FIGS. 14-16, the pullback device 200 includes a frame member 202 having an inner end 204 and an outer end 206. The inner end 204 includes opposing attachment surfaces 208. The outer end 206 includes an attachment location 210.

The pullback device 200 further includes anchor arms 212. Each anchor arm 212 has an inner end 214 and an outer end 216. The inner end 214 of each anchor arm 212 is configured to couple to an attachment surface 208 of the frame member 202. The outer end 216 of each anchor arm 212 includes an attachment location 210.

In the example pullback device 200, the frame member 202 and the anchor arms 212 are radial portions that are part of an anchoring portion that can secure the pullback device 200 to the rotary drill bit 12. As shown in FIG. 14, the anchoring portion is captured between the drill bit base 17 and the conical cutting surfaces of the cutter cones 14 when the pullback device 200 is attached to the rotary drill bit 12.

As shown in FIG. 16, each attachment surface 208 of the frame member 202 can include a threaded bore 218, and the inner end 214 of each anchor arm 212 can include a threaded pin 220 that can be threaded into one of the threaded bores 218 of the frame member 202 for attaching each anchor arm 212 to the frame member 202.

As shown in FIG. 14, when each anchor arm 212 is attached to the frame member 202, the frame member 202 and the anchor arms 212 (e.g., the radial portions of the attachment portion of the pullback device 200) each fit in an open gap 23 between the drill bit base 17 and the cutter cones 14. In the example depicted, the frame member 202 and the anchor arms 212 are equally spaced between the cutter cones 14. For example, the frame member 202 and the anchor arms 212 (e.g., the radial portions of the pullback device 200) are equally spaced from one another by about 120 degrees.

The attachment locations 210 on the frame member 202 and the anchor arms 212 can be part of a product attachment portion that radially aligns with the drill bit central axis when the pullback device 200 is attached to the rotary drill bit 12. The product attachment portion, as defined by the attachment locations 210, can attach desired product to the pullback device 200 such that the pullback device 200 can be used to install the product in a hole when the pullback device 200 is attached to the rotary drill bit 12, and the rotary drill bit 12 is pulled back through the hole.

In the example of FIG. 14, a harness 222 is attached to the attachment locations 210 on the outer ends of the frame member 202 and anchor arms 212 such that the frame member 202 and anchor arms 212 can act as first, second, and third radial anchor arms, respectively. The harness 222 can include an attachment eye (not shown) that aligns generally with the central axis 21 of the rotary drill bit 12 when the pullback device 200 is attached thereto. In some examples, the harness 222 can be used to attach the pullback device 200 to a swivel device (e.g., such as the swivel device 30 shown in FIGS. 1-6). The swivel device can attach product to the pullback device 200 and prevent the product from rotating when the pullback device 200 is pulled back through the hole. In some examples, the attachment locations 210 are eyelets.

Figure 17:
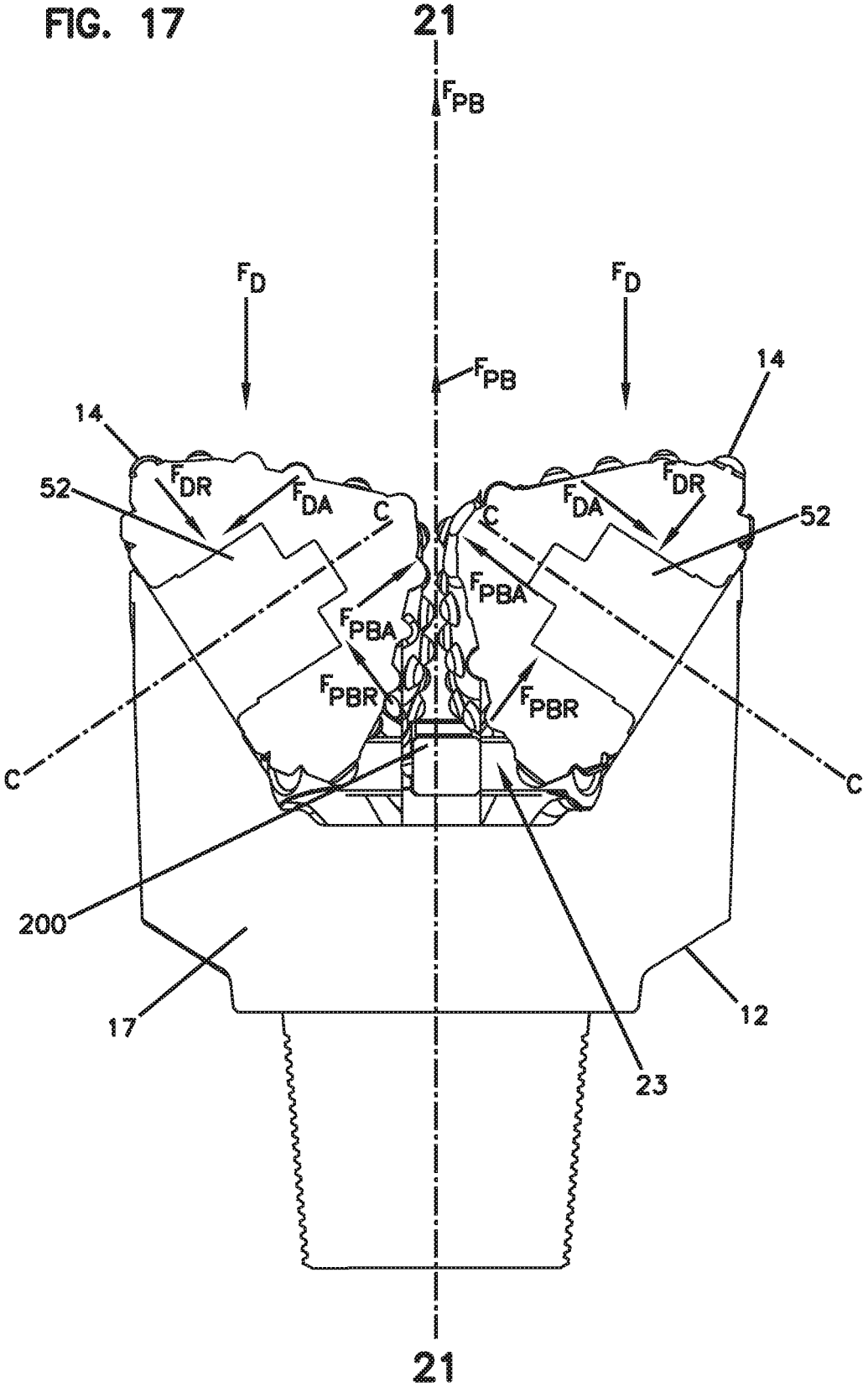
FIG. 17 is a cross-sectional view of the example pullback device of FIG. 14 attached to a rotary drill bit.

FIG. 17 is a cross-sectional view of the pullback device 200 attached to the rotary drill bit 12. As shown in FIG. 17, the frame member 202 and the anchor arms 212 (e.g., the radial portions of the attachment portion of the pullback device 200) each fit in an open gap 23 between the drill bit base 17 and the cutter cones 14 such that the radial portions of the pullback device 200 engage adjacent cutter cones 14 of a rotary drill bit 12, and partially convert an axial pullback force $F_{PBA}$ into a radial pullback force $F_{PBR}$ with respect to the cutter cone rotation axes C-C for each cutter cone. As described above, minimizing the axial pullback force $F_{PBA}$ is advantageous because the axial pullback force $F_{PBA}$ can cause the cutter cones 14 to be pulled off the cutter cone mounting locations 52 during the pullback operation.

Figure 18:
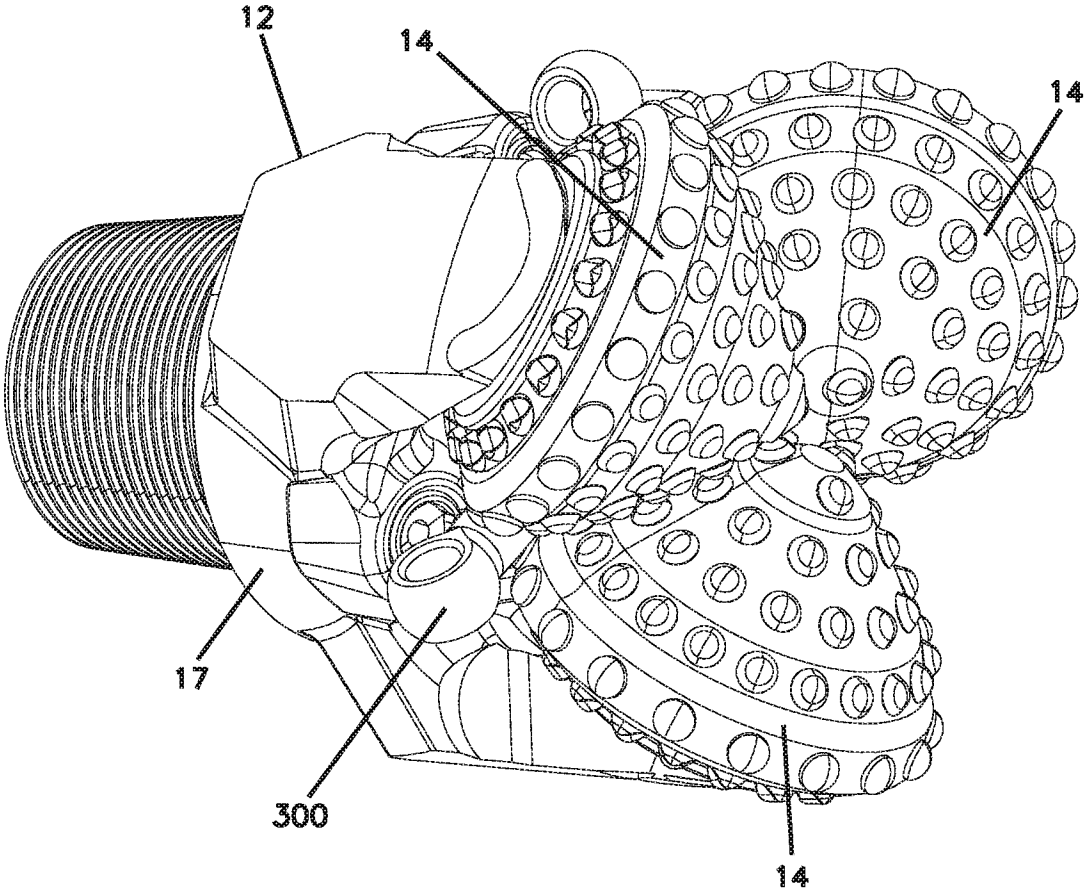
FIG. 18 is an isometric view of another example of a pullback device attached to a rotary drill bit.
Figure 19:
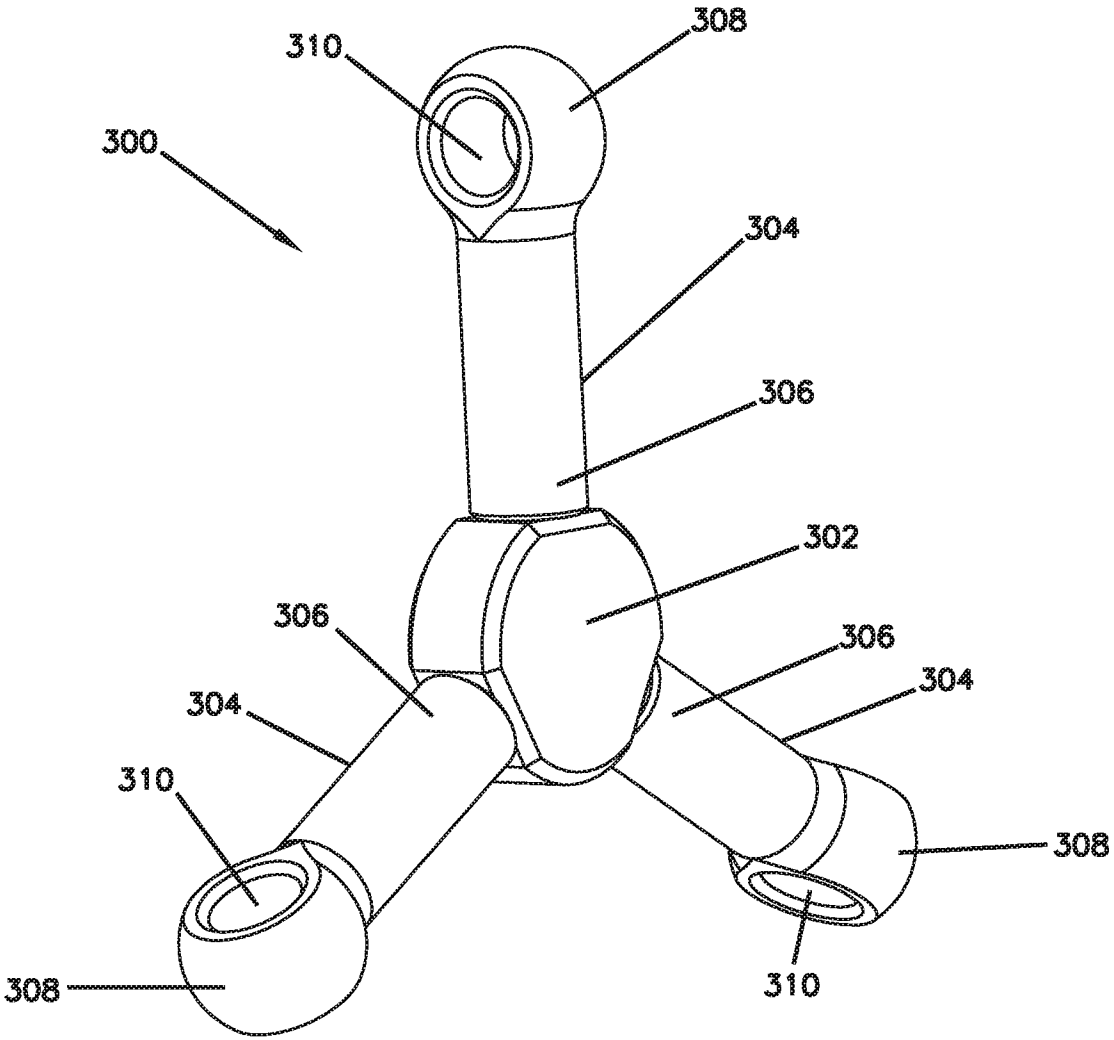
FIG. 19 is an isometric view of the pullback device of FIG. 18.
Figure 20:
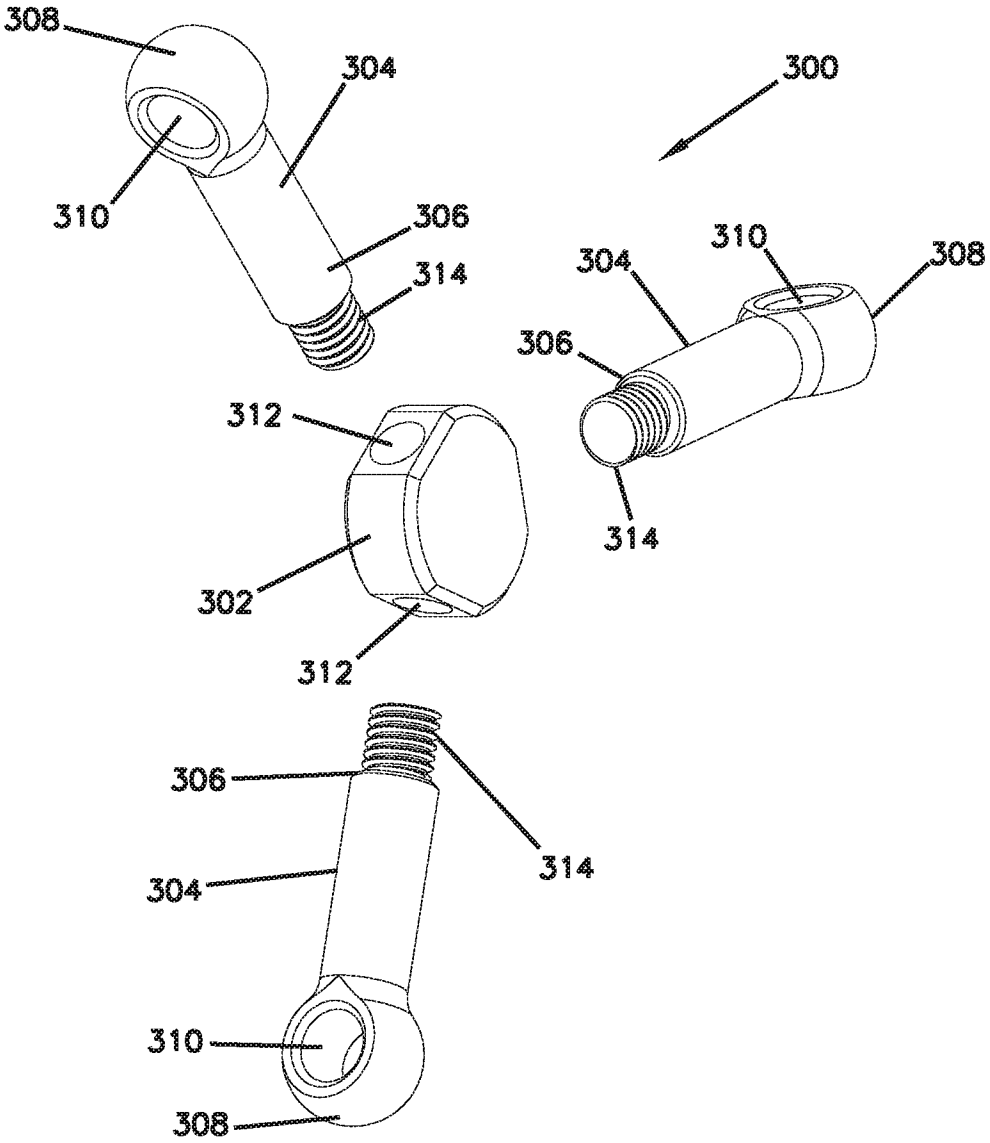
FIG. 20 is an exploded isometric view of the pullback device of FIG. 18.

FIG. 18 is an isometric view of a pullback device 300 attached to the rotary drill bit 12. FIG. 19 is an isometric view of the pullback device 300, and FIG. 20 is an exploded view of the pullback device 300. The pullback device 300 is attachable to the rotary drill bit 12 without disassembling the rotary drill bit 12 or removing the rotary drill bit 12 from a drill string.

As shown in FIGS. 18-20, the pullback device 300 includes a frame member 302, and a plurality of anchor arms 304 attached to the frame member 302. Each anchor arm 304 has a first end 306 coupled to the frame member 302, and a second end 308 that includes an attachment location 310. In the example pullback device 300, each anchor arm 304 is a radial portion that is part of an anchoring portion that can secure the pullback device 300 to the rotary drill bit 12. As shown in FIG. 18, the anchoring portion is captured between the drill bit base 17 and the conical cutting surfaces of the cutter cones 14 when the pullback device 300 is attached to the rotary drill bit 12.

The attachment locations 310 on the anchor arms 304 can be part of a product attachment portion that radially aligns with the central axis of the rotary drill bit 12 when the pullback device 300 is attached to the rotary drill bit. The product attachment portion, as defined by the attachment locations 310, can attach desired product to the pullback device 300 such that the pullback device 300 can be used to install the product in a hole when the pullback device 300 is attached to the rotary drill bit 12, and the rotary drill bit 12 is pulled back through the hole. In the example shown in FIGS. 18-19, the attachment locations 310 are eyelets that can be used to attach product to the pullback device 300. In some examples, the attachment locations 310 can attach the pullback device 300 to a harness (e.g., such as the harness 222 shown in FIG. 14) that can be attached to a swivel device (e.g., such as the swivel device 30 shown in FIGS. 1-6). The swivel device can attach product to the pullback device 300 and prevent the product from rotating when the pullback device 300 is pulled back through the hole.

As shown in FIGS. 19 and 20, the frame member 302 is circular, and the anchor arms 304 (e.g., the radial portions of the pullback device 300) are equally spaced by 120 degrees around the frame member 302. In the example shown in FIG. 20, the frame member 302 has a plurality threaded bores 312, and the first end 306 of each anchor arm 304 includes a threaded pin 314 that can be screwed into one of the threaded bores 312 of the frame member 302 to attach each anchor arm 304 to the frame member 302.

Figure 21:
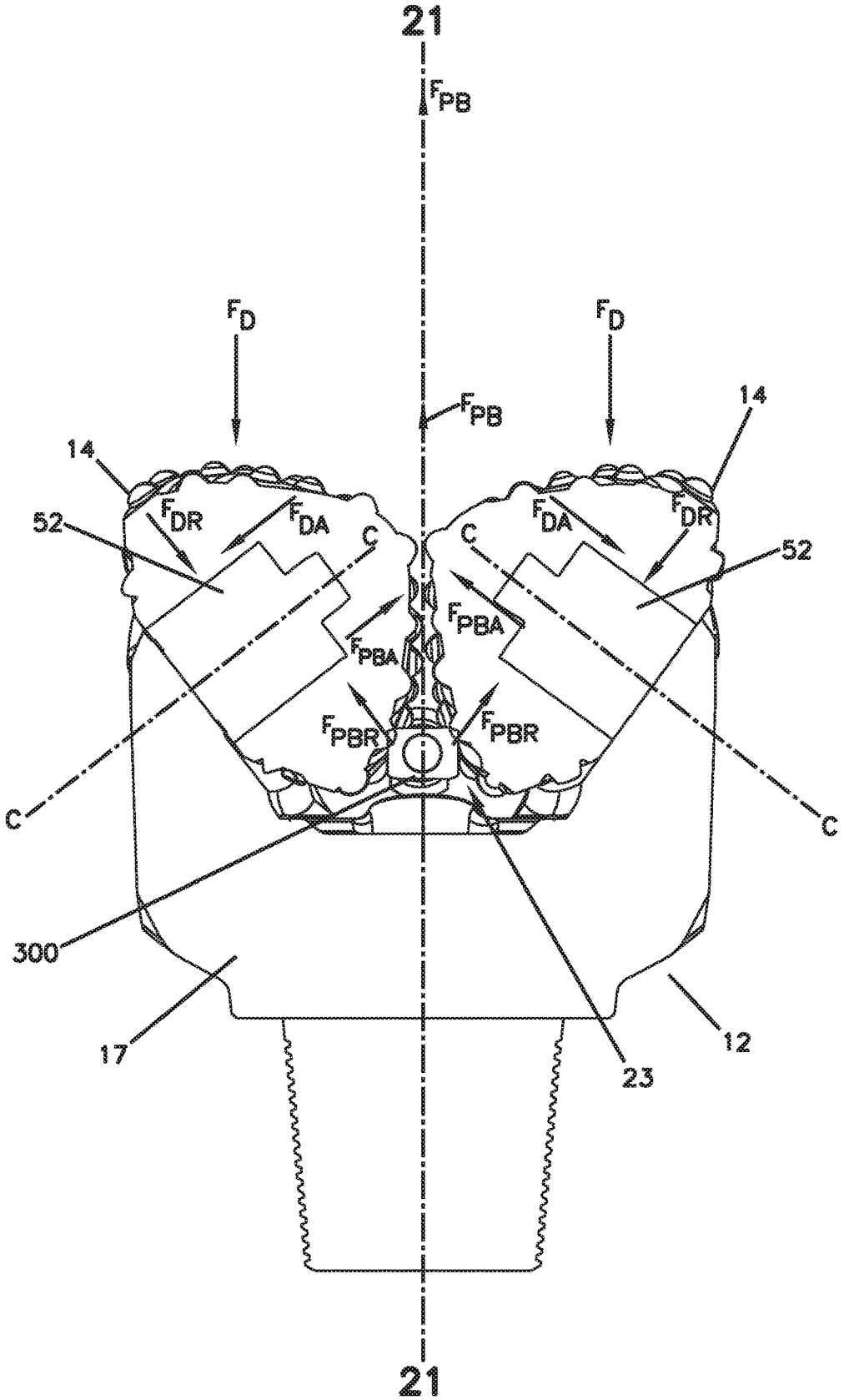
FIG. 21 is a cross-sectional view of the pullback device of FIG. 18 attached to a rotary drill bit.

FIG. 21 is a cross-sectional view of the pullback device 300 attached to the rotary drill bit 12. As shown in FIG. 21, the anchor arms 304 (e.g., the radial portions of the attachment portion of the pullback device 300) are each configured to fit in an open gap 23 between the drill bit base 17 and adjacent cutter cones 14. Thus, when mounted to the rotary drill bit 12, the second ends 308 of the anchor arms 304 each engage adjacent cutter cones 14, and can partially convert an axial pullback force $F_{PBA}$ into a radial pullback force $F_{PBR}$ with respect to the cutter cone rotation axes C-C for each cutter cone. As described above, minimizing the axial pullback force $F_{PBA}$ is advantageous because the axial pullback force $F_{PBA}$ can cause the cutter cones 14 to be pulled off the cutter cone mounting locations 52 during the pullback operation.

Figure 22:
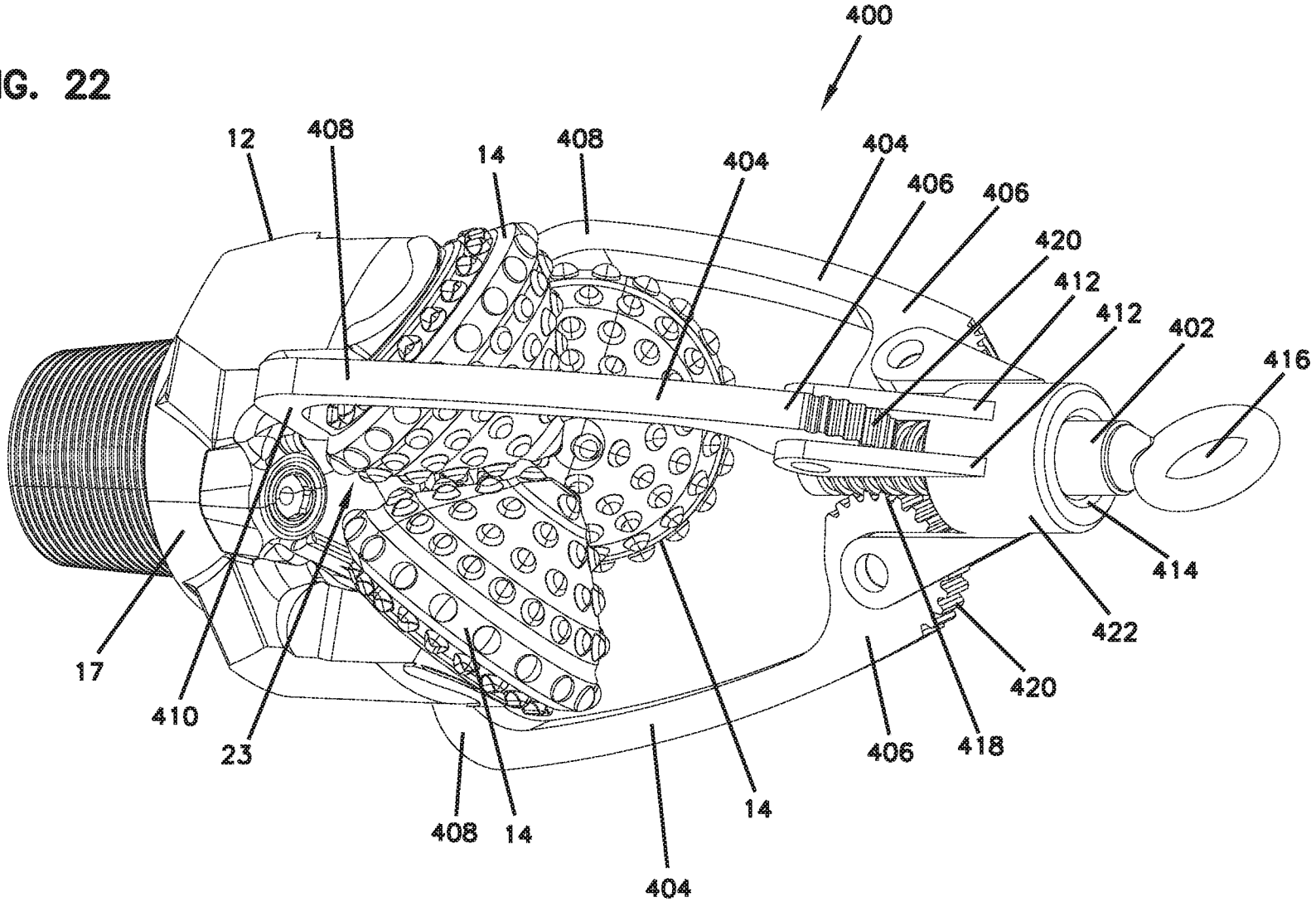
FIG. 22 is an isometric view of another example of a pullback device attached to a rotary drill bit.
Figure 23:
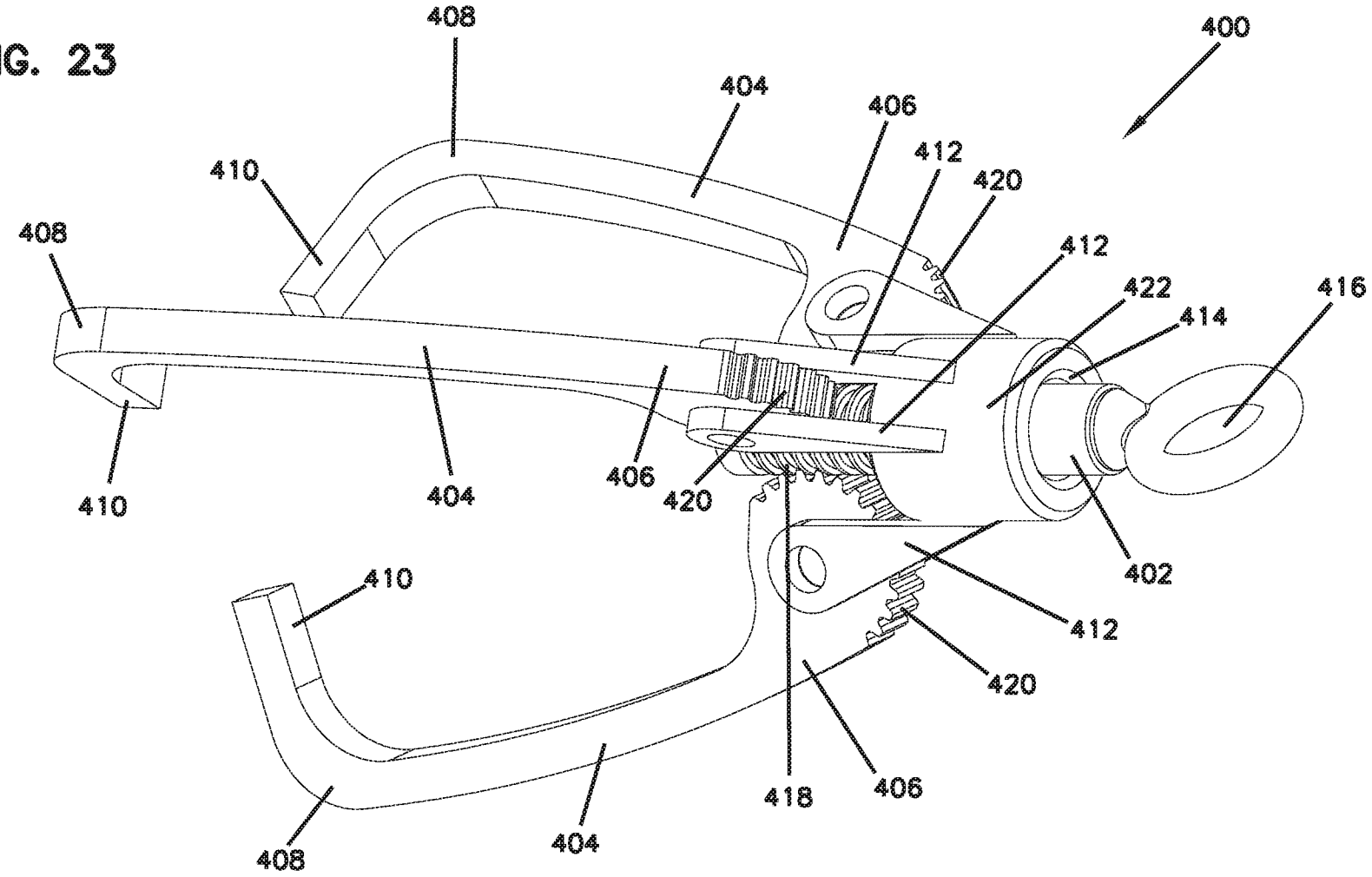
FIG. 23 is an isometric view of the example pullback device of FIG. 22.

FIG. 22 is an isometric view of another example of a pullback device 400 attached to the rotary drill bit 12. FIG. 23 is a isometric view of the pullback device 400. As shown in FIGS. 22 and 23, the pullback device 400 has a grapple design having a circular rack and gear concept. The pullback device 400 includes a center pin 402 having a circular rack 418, and includes anchor arms 404 each having a first end 406 and a second end 408. The first end 406 of each anchor arm 404 includes a geared surface 420 that engages the circular rack 418 on the center pin 402. The second end 408 of each anchor arm 404 has a claw 410 that can fit in the open gaps 23 between the drill bit base 17 and the cutter cones 14 of the rotary drill bit 12. The pullback device 400 is held together by a collar 422 having mounts 412 for pivotally attaching the anchor arms 404 to the pullback device 400. The center pin 402 is constrained by an aperture 414 in the collar 422 and the length of the geared surface 420 on the anchor arms 404 and the circular rack 418. During pullback, the pullback force $F_{PB}$ on the center pin 402 transfers between the circular rack 418 and the geared surface 420 on the anchor arms 404 causing the anchor arms 404 to clamp against the cutter cones 14 of the rotary drill bit 12. Product can be attached by means of a coupler (which may be a swivel device) to an attachment location 416 on the center pin 402. In the example shown, the attachment location 416 is an eyelet.

Figure 24:
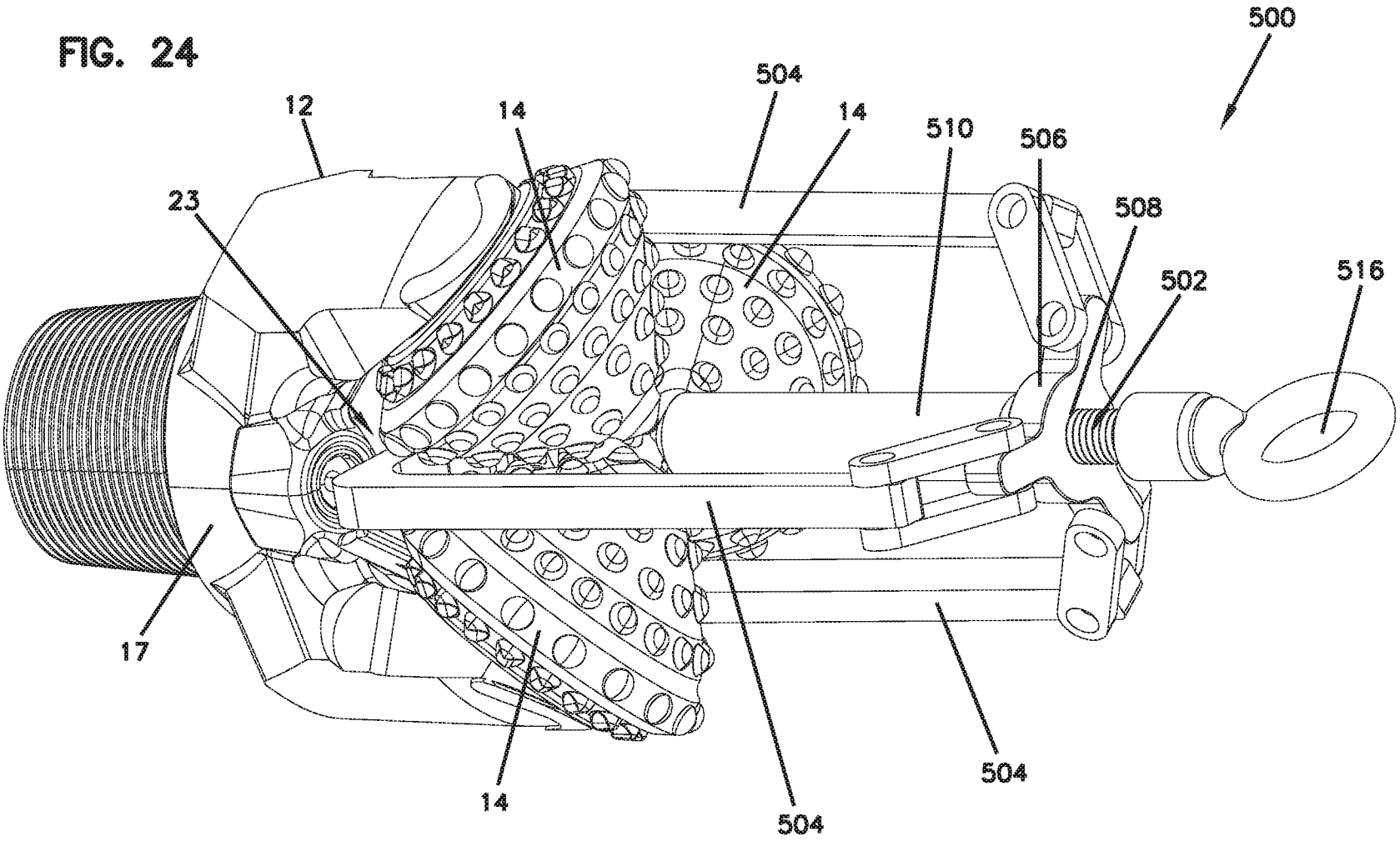
FIG. 24 is an isometric view of another example of a pullback device attached to a rotary drill bit.
Figure 25:
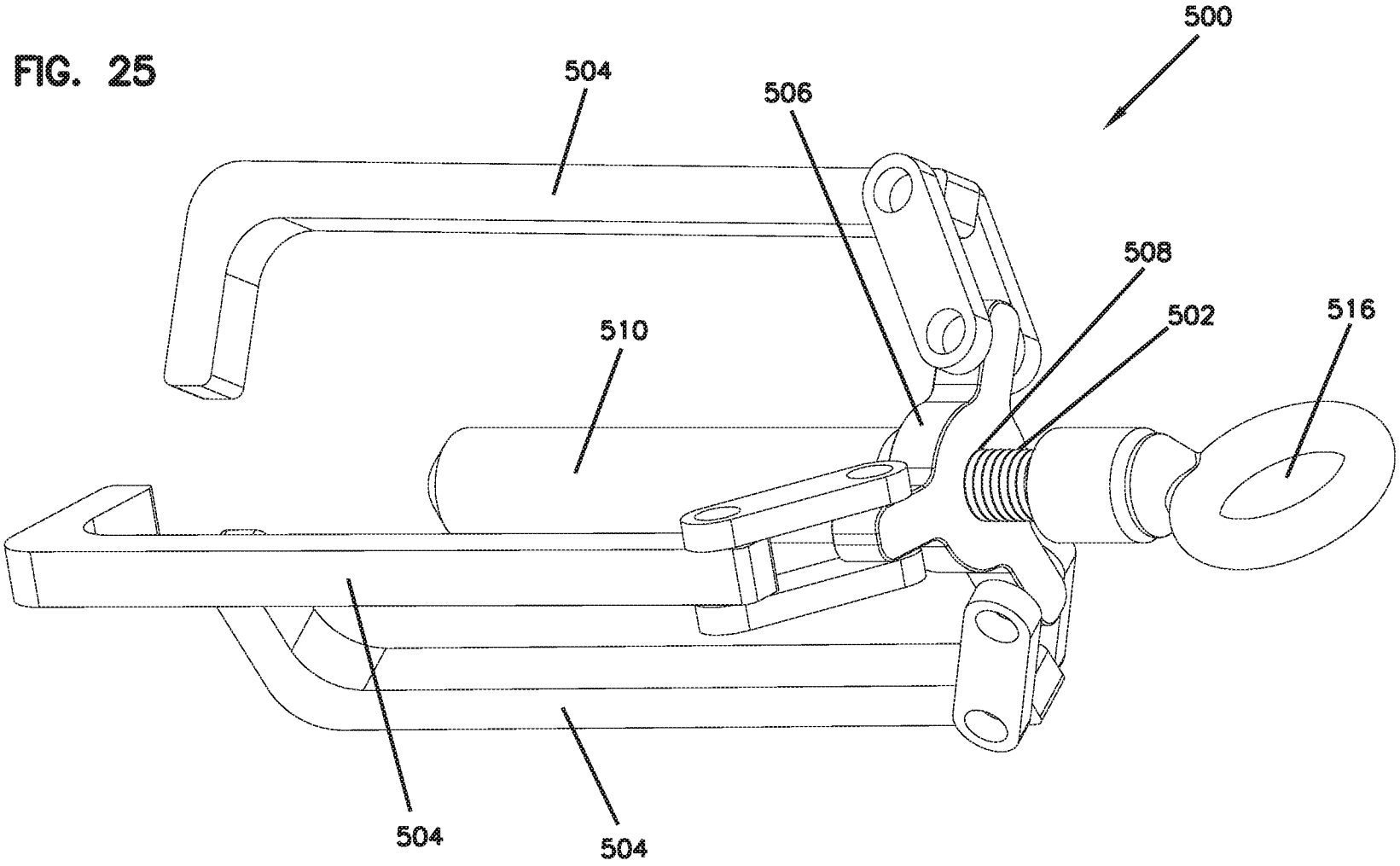
FIG. 25 is an isometric view of the example pullback device of FIG. 24.

FIG. 24 is an isometric view of another example of a pullback device 500 attached to the rotary drill bit 12. FIG. 25 is a isometric view of the pullback device 500. As shown in FIGS. 24 and 25, the pullback device 500 has a grapple design with a threaded center pin 502 and dowel 510. A frame member 506 having a threaded aperture 508 engages and constrains the threaded center pin 502. The pullback device 500 is held together by the frame member 506 to which anchor arms 504 are attached directly, or through linkages 512. The pullback device 500 is attached to the rotary drill bit 12 by withdrawing the dowel 510 to open the anchor arms 504 and place the anchor arms 504 around and under the cutter cones 14 (e.g., into the open gaps 23 between the drill bit base 17 and the cutter cones 14). Thereafter, the dowel 510 can be inserted and extended into the center of the rotary drill bit 12 by using the threaded center pin 502 until the dowel 510 presses against the center of the rotary drill bit 12 to create tension (e.g., a binding effect) on the anchor arms 504, which secures the pullback device 500 to the rotary drill bit 12. Product can be attached by means of a coupler (which may be a swivel device) to an attachment location 516 on the center pin 502. In the example shown, the attachment location 516 is an eyelet.

Figure 26:
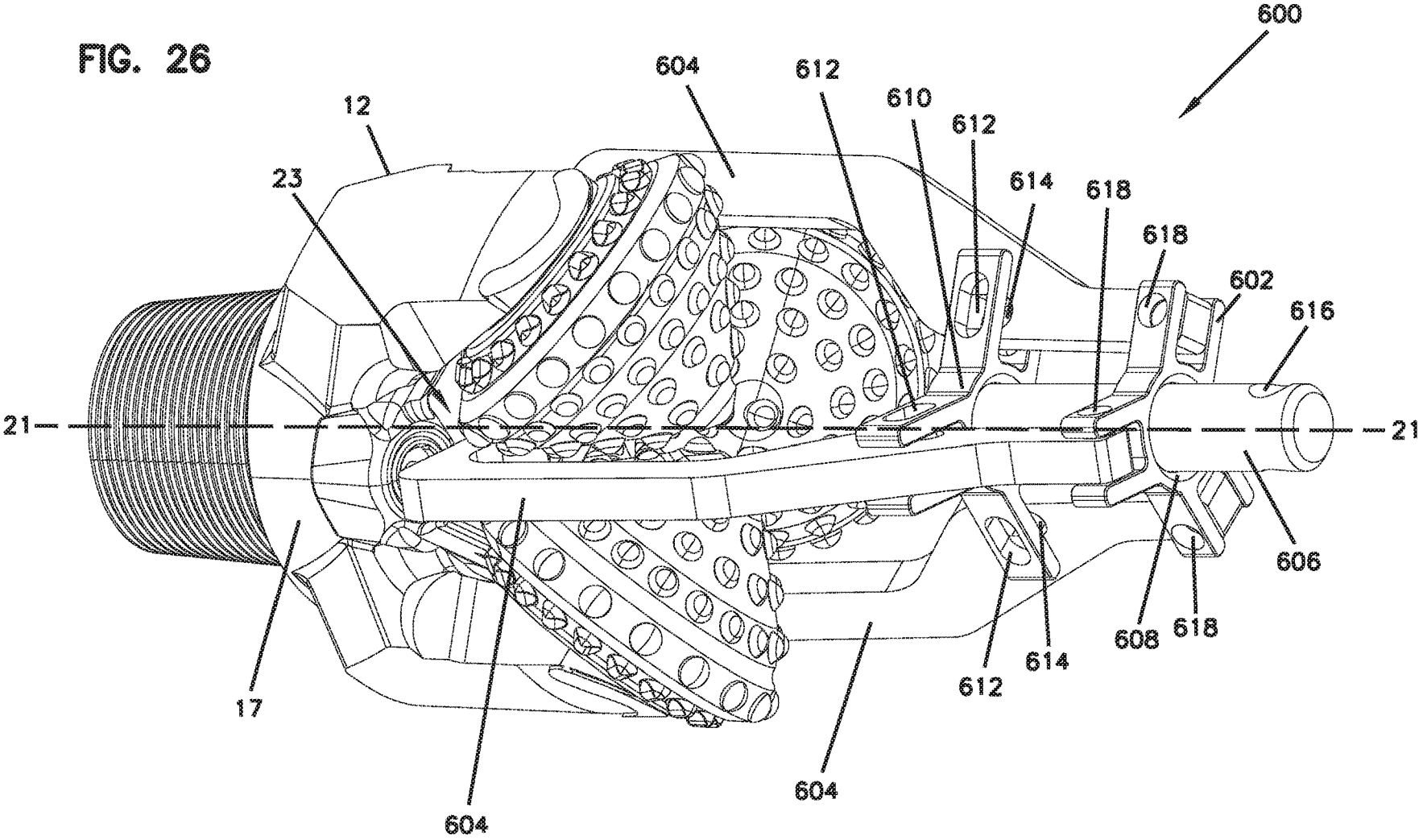
FIG. 26 is an isometric view of another example of a pullback device attached to a rotary drill bit.
Figure 27:
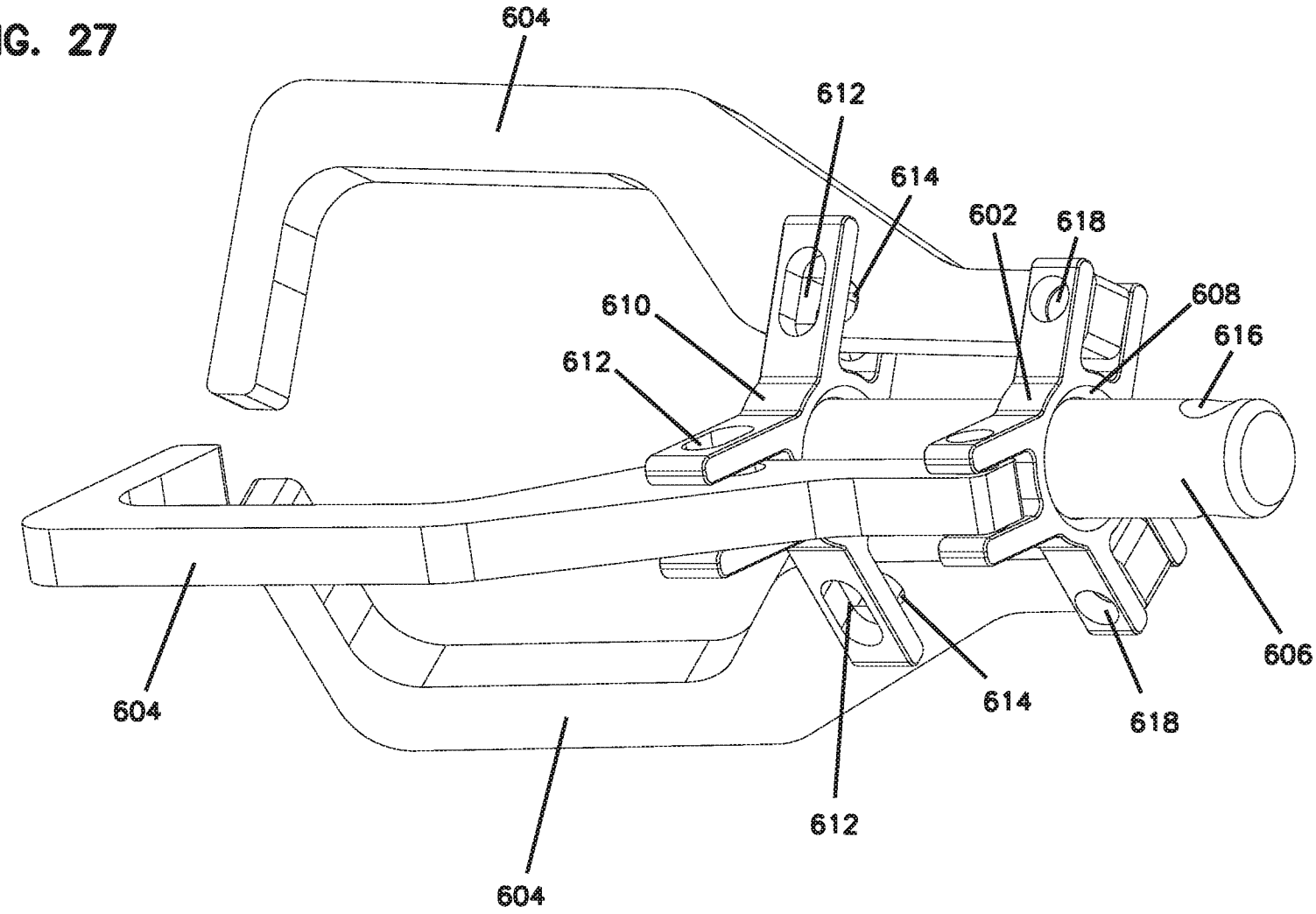
FIG. 27 is an isometric view of the example pullback device of FIG. 26.

FIG. 26 is an isometric view of another example of a pullback device 600 attached to the rotary drill bit 12. FIG. 27 is a isometric view of the pullback device 600. As shown in FIGS. 26 and 27, the pullback device 600 has a grapple design with a frame member 602 and anchor arms 604 that are pivotally attached thereto via pivot locations 618. A center pin 606 is inserted through an aperture 608 in the frame member 602. The pullback device 600 further includes a locking device 610 that fits around the center pin 606. The locking device 610 includes a plurality of apertures 612 that align with corresponding apertures 614 in the anchor arms 604. During pullback, pins or similar devices (not shown) can be inserted through each aperture 612 of the locking device 610 and corresponding aperture 614 in the anchor arm 604 such that the pivoting movement of the anchor arms 604 is restricted radially, relative to the central axis 21 of the rotary drill bit 12, such that the anchor arms 604 are secured in the open gaps 23 between the drill bit base 17 and the cutter cones 14. Each anchor arm 604 can be individually detached from the locking device 610 (e.g., by removing the pin from the aperture 612) such that the anchor arms 604 can pivot in at least one location with respect to the rotary drill bit 12 to attach or detach the pullback device 600 from the rotary drill bit 12. Product can be attached by a coupler (which may be a swivel device) to an attachment location 616 on the center pin 606. In the example shown, the attachment location 616 is an eyelet.

Figure 28:
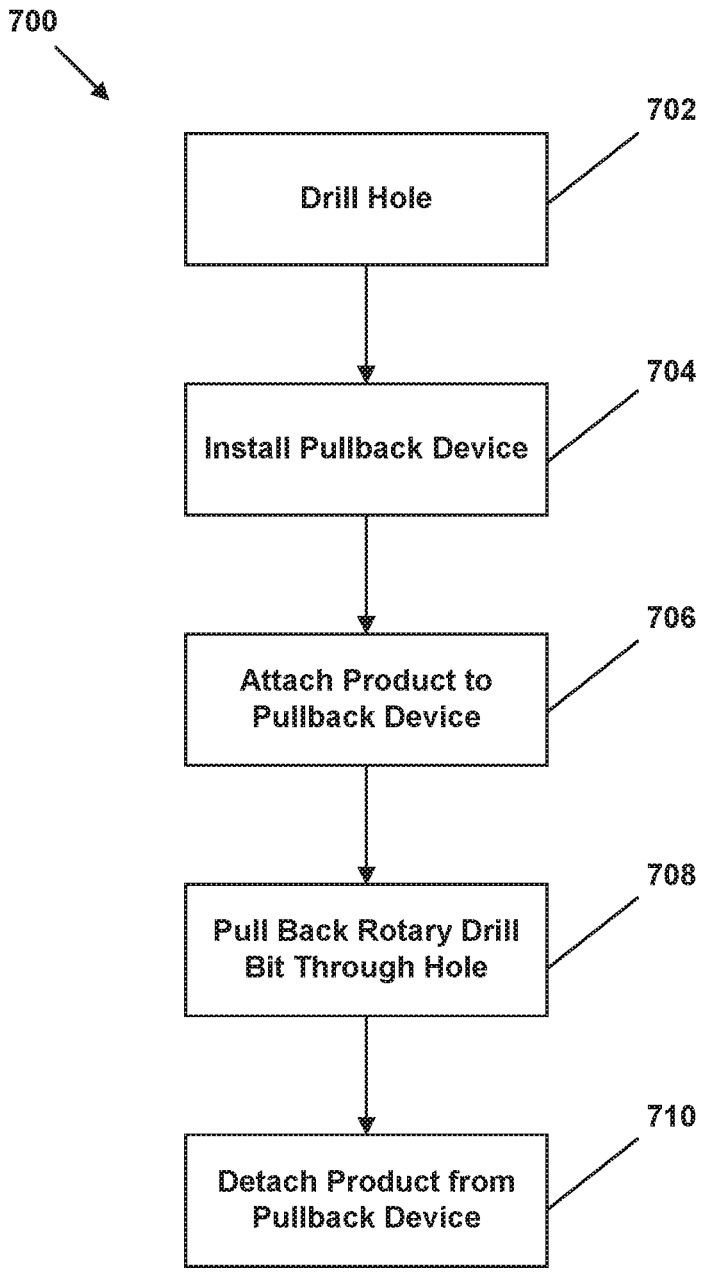
FIG. 28 illustrates a method of installing product in a hole.

FIG. 28 illustrates a method 700 of installing product in a hole. As shown in FIG. 28, the method includes a first step 702 of using a rotary drill bit having a plurality of cutter cones to drill a hole in a substantially horizontal direction with respect to a ground surface. The rotary drill bit can be substantially similar to the rotary drill bit 12 shown in FIGS. 1-6, and described above. For example, the rotary drill bit can be a tri-cone drill bit that includes a plurality of cutter cones, each cutter cone having conical cutting surfaces that encircle a rotation axis of each cutter cone.

After completing the hole such that the rotary drill bit has traveled from a start location to an end location, the method 700 includes a step 704 of installing a pullback device to the rotary drill bit at the end location, the pullback device being installed in open gaps between a drill bit base and adjacent cutter cones of the rotary drill bit. In some examples, a trench can be dug into the ground at the end location so that the pullback device can be attached to the rotary drill bit at the end location.

In some examples, the step 704 of installing the pullback device to the rotary drill bit can include pivoting a plurality of anchor arms of the pullback device so that each anchor arm fits in a gap between the drill bit base and adjacent cutter cones. In some examples, the step 704 of installing the pullback device to the rotary drill bit can further include inserting a locking device through an opening in a frame member of the pullback device after each anchor arm has been fitted in a gap between the drill bit base and adjacent cutter cones to prevent the anchor arms from pivoting. In some examples, the step 704 of installing the pullback device to the rotary drill bit can further include inserting a pin through a bore in the locking device for restraining the locking device within the opening in the frame member of the pullback device.

The method 700 includes a further step 706 of attaching product to the pullback device at the end location. In some examples, the product can be attached directly to the pullback device. In other examples, the product can be attached to a swivel device (such as the swivel device 30 shown in FIGS. 1-6), and the swivel device is attached to the pullback device to prevent the pullback device from rotating the product in the hole.

Thereafter, the method 700 includes a further step 708 of pulling back the rotary drill bit through the hole from the end location to the start location. In some examples, the rotary drill bit is attached to a distal end of a drill string, and the drill string can be pulled through the hole by a drive mechanism.

Afterwards, the method 700 includes a step 710 of detaching the product from the pullback device at the start location, thereby leaving the product installed in the hole. In some examples, the method 700 further includes detaching the pullback device from the rotary drill bit by removing a pin from a locking device of the pullback device, removing the locking device from a frame member of the pullback device, and pivoting the anchor arms of the pullback device to disengage the cutter cones of the rotary drill bit to remove the pullback device from the rotary drill bit.

Figure 29:
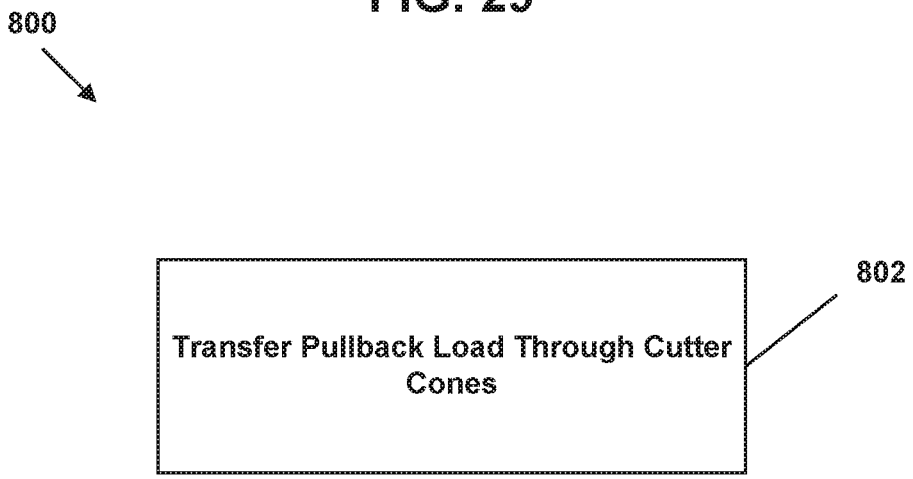
FIG. 29 illustrates a method for pulling back product in a hole.

As a further example, FIG. 29 illustrates a method 800 for pulling back product in a hole that has been drilled by a drill string that includes a rotary drill bit having a drill bit base adapted to be connected to the distal end of the drill string. The drill bit base defines a drill bit central axis about which the drill bit base is rotated during drilling. The drill bit base includes a plurality of cutter cone mounting locations spaced circumferentially about the drill bit central axis, and the rotary drill bit includes cutter cones mounted at the cutter cone mounting locations. The cutter cones are mounted to rotate relative to the drill bit base about cutter cone axes. The cutter cone axes are oriented at oblique journal angles relative to the drill bit central axis. The cutter cones include conical cutting surfaces that encircle the cutter cone axes. As shown in FIG. 29, the method 800 includes a step 802 of pulling back the product by transferring a pullback load through the cutter cones such that the pullback load has first force vectors that are perpendicular to the cutter cone axes (e.g., such as the radial pullback force $F_{PBR}$ shown in FIG. 12) and second force vectors that are parallel to the cutter cone axes (e.g., such as the pullback force $F_{PBA}$ shown in FIG. 12). In some examples, a drive mechanism can be used to pullback the product.

Figure 30:
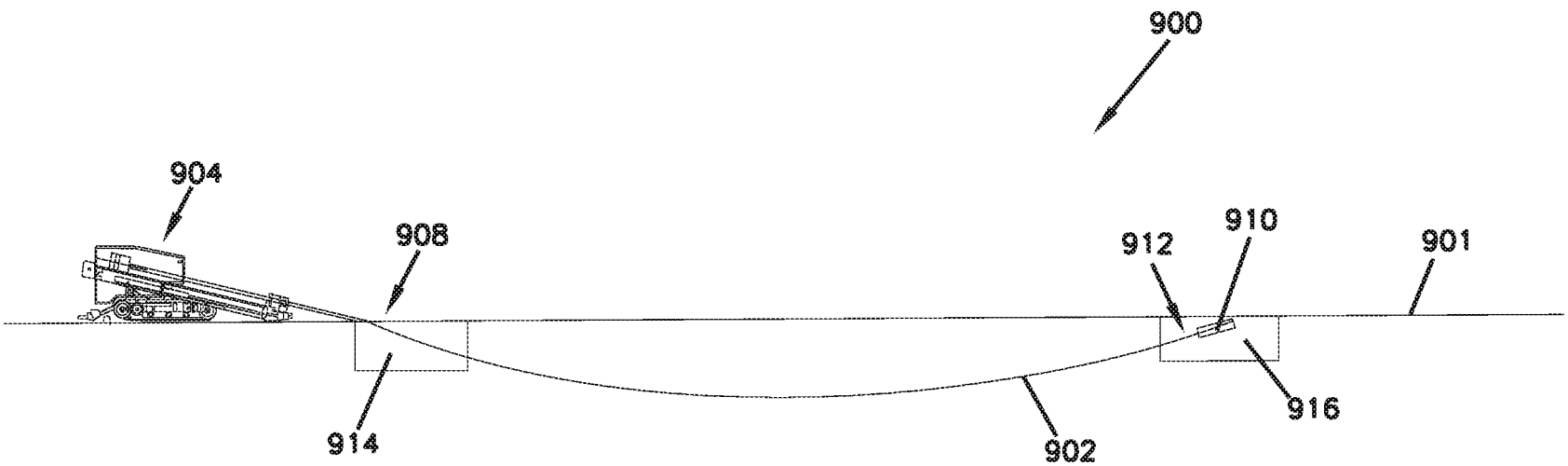
FIG. 30 illustrates a schematic side view of a dual rod drilling system.

FIG. 30 illustrates a schematic side view of a dual rod drilling system 900. As shown in FIG. 30, the dual rod drilling system 900 includes a drill string 902 that is directed into the ground 901 by a drilling machine 904.

The drill string 902 includes multiple drill rod assemblies that are connected to the drilling machine 904 at an up-hole end 908 and a rotary drill bit 910 at a downhole end 912. The drill rod assemblies are strung together end-to-end to form the drill string 902, which can extend significant distances in some drilling applications.

Each drill rod assembly includes an outer tubular drill rod and a smaller, inner drill rod. The inner drill rod fits inside the tubular outer drill rod. The inner drill rod of each drill rod assembly is interconnected to the adjacent inner drill rods.

During a drilling operation, multiple drill rod assemblies can be added to the drill string 902. When coupled, the drilling machine 904 can simultaneously rotate one or both of the outer and inner drill rods of each drill rod assembly. Once the drilling operation is complete, the drill rod assemblies are removed from the drill string 902 during a pullback operation. As shown in FIG. 30, a trench 914 can be dug at the up-hole end 908 to facilitate insertion of the drill string 902 into the ground 901. In some examples, the trench 914 is a start location. Another trench 916 can be dug at the downhole end 912 to facilitate attachment of a pullback device, in accordance with examples described herein, to the rotary drill bit 910 after completion of the drilling operation, so that the pullback device can be used to install product in the ground 901 during a pullback operation. In some examples, the trench 916 is an end location.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed:

1. A pullback system for installing product in a hole, the system comprising:

a rotary drill bit having a main body with a central axis, and a plurality of cutter cones rotatably mounted to the main body, each cutter cone having a conical cutting surface; and a pullback device attachable to the rotary drill bit without disassembling the rotary drill bit or removing the rotary drill bit from a drill string, the pullback device having:

a frame member;

a plurality of anchor arms, each anchor arm having a first end coupled to the frame member and a second end having a radial portion extending inwardly toward the central axis; and an attachment location on the pullback device configured to attach the product to the pullback device;

wherein each radial portion engages adjacent cutter cones of the rotary drill bit when positioned between two opposing conical cutting surfaces to mount the pullback device to the rotary drill bit.

2. The pullback system of claim 1, wherein the pullback device includes three anchor arms equally spaced between the cutter cones of the rotatory drill bit.

3. The pullback system of claim 1, wherein the at least one attachment location attaches the pullback device to a swivel device, the swivel device configured to attach the product to the pullback device and to prevent the product from rotating inside the hole when the pullback device is pulled back through the hole.

4. The pullback system of claim 1, wherein each anchor arm is pivotally connected to the frame member at the first end, and wherein each anchor arm includes a feature having a locking surface between the first end and the second end; and the pullback system further includes a locking device insertable through an opening in the frame member, the locking device having a first end that surrounds the locking surfaces of the anchor arms so that the plurality of anchor arms cannot pivot with respect to the frame member, and the locking device having a second end that includes the attachment location.

5. The pullback system of claim 4, further comprising a pin, and wherein the locking device includes a bore between the first end and the second end, and the pin is insertable in the bore for restraining the locking device within the frame member.

6. The pullback system of claim 4, wherein the locking device includes a hollow cylindrical body that is open on the first end and closed on the second end, and wherein the locking surfaces of the anchor arms are surrounded by the cylindrical body at the first end when the locking device is inserted through the opening in the frame member.

7. The pullback system of claim 4, wherein each locking surface is substantially parallel to a longitudinal axis of the respective anchor arm.

8. The pullback system of claim 4, wherein the anchor arms are pivotable with respect to the frame member when the locking device is not inserted in the opening in the frame member such that the second ends can engage and disengage adjacent cutter cones of the rotary drill bit.

9. The pullback system of claim 1, wherein each anchor arm is pivotally connected to the frame member at the first end, and the second end is configured to engage adjacent cutter cones of the rotary drill bit and to apply a radial pullback force to a rotation axis of each cutter cone.

10. The pullback system of claim 1, wherein the radial portions of the anchor arms each fit in an open gap between a drill bit base and adjacent cutter cones of the rotary drill bit.

11. The pullback system of claim 1, wherein portions of the anchor arms are configured to extend between adjacent cutter cones of the rotary drill bit in a direction parallel to the drill bit central axis.

12. The pullback device of claim 1, wherein each of the plurality of anchor arms is pivotally connected at the first end to the frame member to be pivotable between an expanded position and a constricted position, and in the constricted position, portions of the anchor arms are configured to extend between adjacent cutter cones of the rotary drill bit in a direction parallel to the drill bit central axis.

13. A pullback device comprising:

a frame member;

a plurality of anchor arms, each anchor arm pivotally connected to the frame member at a first end, and having a second end configured to engage a rotary drill bit and to apply a pullback force to the rotary drill bit, each anchor arm configured to extend between adjacent cutter elements of the rotary drill bit and further having a feature that includes a locking surface between the first end and the second end; and a locking device insertable through an opening in the frame member, when inserted, the locking device having a first end that surrounds the locking surfaces of the anchor arms such that the plurality of anchor arms cannot pivot with respect to the frame member, and the locking device having a second end that includes an attachment location configured to attach a product to the pullback device.

14. The pullback device of claim 13, wherein the pullback device includes three anchor arms equally spaced circumferentially around the frame member.

15. The pullback device of claim 13, wherein the second end of each anchor arm is configured to fit in a gap between a drill bit base and adjacent cutter cones that define the cutter elements of the rotary drill bit.

16. The pullback device of claim 13, wherein the locking surface of each anchor arm is substantially parallel to a longitudinal axis of the respective anchor arm.

17. The pullback device of claim 13, further comprising a pin, and wherein the locking device includes a bore between the first end and the second end, and the pin is insertable in the bore for restraining the locking device within the frame member.

18. The pullback device of claim 13, wherein the locking device includes a hollow cylindrical body that is open on the first end and closed on the second end, and wherein the locking surface of each anchor arm is surrounded by the cylindrical body at the first end when the locking device is inserted through the opening in the frame member.

19. The pullback device of claim 13, wherein the attachment location is an eyelet for attaching the pullback device to a swivel device, and the swivel device is configured to attach the product to the pullback device and to prevent the product from rotating inside the hole when the pullback device is pulled back through the hole.

20. A pullback system for installing product in a hole, the system comprising:

a rotary drill bit having a plurality of cutter cones; and a pullback device attachable to the rotary drill bit without disassembling the rotary drill bit or removing the rotary drill bit from a drill string, the pullback device having:

a frame member;

three anchor arms equally spaced about the frame member, each anchor arm having a first end pivotally coupled to the frame member and a second end configured to fit in an open gap between a drill bit base and adjacent cutter cones of the rotary drill bit, each anchor arm having a feature that includes a locking surface between the first end and the second end; and a locking device insertable through an opening in the frame member, when inserted, the locking device having a first end that surrounds the locking surfaces of the anchor arms such that the three anchor arms cannot pivot with respect to the frame member, and the locking device having a second end that includes an attachment location configured to attach a product to the pullback device.

* * * * *